US011193238B2

(12) United States Patent
Oguchi et al.

(10) Patent No.: US 11,193,238 B2
(45) Date of Patent: Dec. 7, 2021

(54) SHEET MANUFACTURING APPARATUS AND CONTROL METHOD FOR SHEET MANUFACTURING APPARATUS

(71) Applicant: SEIKO EPSON CORPORATION, Tokyo (JP)

(72) Inventors: Yuki Oguchi, Nagano (JP); Takao Mikoshiba, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 463 days.

(21) Appl. No.: 16/328,347

(22) PCT Filed: Aug. 3, 2017

(86) PCT No.: PCT/JP2017/028286
§ 371 (c)(1),
(2) Date: Feb. 26, 2019

(87) PCT Pub. No.: WO2018/043030
PCT Pub. Date: Mar. 8, 2018

(65) Prior Publication Data

US 2021/0292970 A1 Sep. 23, 2021

(30) Foreign Application Priority Data

Aug. 31, 2016 (JP) ..... JP2016-169471

(51) Int. Cl.
*B27N 3/04* (2006.01)
*B27N 3/26* (2006.01)
(Continued)

(52) U.S. Cl.
CPC ..... *D21F 9/02* (2013.01); *B27N 3/04* (2013.01); *B27N 3/26* (2013.01); *D04H 1/732* (2013.01);
(Continued)

(58) Field of Classification Search
CPC .. D21F 9/02; D21F 7/006; D21F 9/00; D21G 9/0018; D21G 9/00; D21G 9/009;
(Continued)

(56) References Cited

U.S. PATENT DOCUMENTS 5,611,891 A * 3/1997 Hundley, III ..... D21F 1/08 162/198
8,986,505 B2 * 3/2015 Oguchi ..... D21F 9/00 162/259
(Continued)

FOREIGN PATENT DOCUMENTS

EP 1767690 A2 * 3/2007 ..... D21G 9/0018
EP 3508634 A1 * 7/2019 ..... D21F 9/00
(Continued)

*Primary Examiner* — Jose A Fortuna
(74) *Attorney, Agent, or Firm* — Global IP Counselors, LLP

(57) ABSTRACT

A defibrating unit that defibrates a raw material including fibers in an atmosphere, an accumulating unit that discharges defibrated matter by rotating a drum unit in which a plurality of openings are formed, a second web forming unit that forms a second web by operating a mesh belt on which the defibrated matter is accumulated, a sheet forming unit that forms a sheet from the second web, a cutting unit that cuts the sheet into a preset size, and a control unit that executes a stop control with a cut operation of the cutting unit as a trigger in a case where an instruction to stop an apparatus is provided are included. In the stop control, the control unit stops operation of the defibrating unit after stopping rotation of the drum unit and movement of the mesh belt.

9 Claims, 9 Drawing Sheets

(51) Int. Cl.

| | |
|---|---|
| ***D04H 1/732*** | (2012.01) |
| ***D21B 1/06*** | (2006.01) |
| ***D21G 9/00*** | (2006.01) |
| ***D21H 23/20*** | (2006.01) |
| ***D21F 9/02*** | (2006.01) |
| ***D21F 7/00*** | (2006.01) |
| ***D21H 17/33*** | (2006.01) |

(52) U.S. Cl.
CPC ..... *D21B 1/063* (2013.01); *D21F 7/006* (2013.01); *D21G 9/0018* (2013.01); *D21H 17/33* (2013.01); *D21H 23/20* (2013.01)

(58) Field of Classification Search
CPC .... D21G 9/0027; D21G 9/0054; D21B 1/063; D21H 23/20; D21H 17/33; B27N 3/26; B27N 3/04; D04H 1/732; D21C 9/1052; G05B 19/41865; G05B 13/021; G05B 19/418; G05B 2219/34418; G05B 23/022
See application file for complete search history.

(56) References Cited

U.S. PATENT DOCUMENTS 9,463,579 B2 * 10/2016 Oguchi ..... D04H 1/732
9,498,896 B2 * 11/2016 Oguchi ..... D04H 1/732
9,574,304 B2 * 2/2017 Oguchi ..... D21B 1/063
9,637,860 B2 * 5/2017 Miyazawa ..... B27N 3/04
10,100,466 B2 * 10/2018 Gomi ..... D21B 1/10
10,145,046 B2 * 12/2018 Miyazawa ..... B32B 5/26
10,146,217 B2 * 12/2018 Pauly ..... G06F 16/9535
10,350,784 B2 * 7/2019 Murayama ..... B27N 3/002
10,563,351 B2 * 2/2020 Murayama ..... D21B 1/06
10,619,302 B2 * 4/2020 Gomi ..... D21F 9/00
10,647,020 B2 * 5/2020 Oguchi ..... B07B 9/02
10,647,022 B2 * 5/2020 Nagai ..... B27N 3/12
10,895,869 B2 * 1/2021 Taniguchi ..... G05B 19/418
11,001,970 B2 * 5/2021 Taniguchi ..... D04H 1/732
11,005,133 B2 * 5/2021 Oguchi ..... D21F 9/00
11,008,707 B2 * 5/2021 Yoda ..... D21F 7/00
11,028,536 B2 * 6/2021 Miyasaka ..... D21D 1/02
11,060,242 B2 * 7/2021 Abe ..... D21F 9/00
2002/0104635 A1 * 8/2002 Wells ..... G01N 21/8921 162/198
2002/0177909 A1 * 11/2002 Fu ..... G05B 17/02 700/28
2003/0216828 A1 * 11/2003 Puurtinen ..... D21F 9/003 700/128
2004/0238140 A1 * 12/2004 Laitinen-Vellonen .... D21F 1/66 162/198
2008/0140439 A1 * 6/2008 Hoffman ..... G06Q 30/0206 705/317
2009/0106290 A1 * 4/2009 Rivard ..... G05B 23/0229
2009/0185162 A1 * 7/2009 Shakespeare ..... G01N 21/33 356/51
2014/0110871 A1 * 4/2014 Backstrom ..... D21G 9/0027 264/40.1
2014/0290884 A1 * 10/2014 Yamagami ..... D21G 9/0018 162/158
2014/0290889 A1 * 10/2014 Oguchi ..... D21B 1/08 162/259
2015/0096705 A1 * 4/2015 Fujita ..... D04H 1/00 162/348
2015/0176204 A1 * 6/2015 Miyazawa ..... D21F 9/00 162/263
2015/0184341 A1 * 7/2015 Tanaka ..... D04H 1/736 162/252
2015/0204015 A1 * 7/2015 Gomi ..... B29C 35/0277 162/261
2015/0240418 A1 * 8/2015 Oguchi ..... D21G 9/0009 162/109
2015/0240422 A1 * 8/2015 Oguchi ..... D21D 5/24 162/202
2015/0247286 A1 * 9/2015 Nagai ..... D21F 9/00 162/261
2015/0251867 A1 * 9/2015 Higuchi ..... B65H 20/10 226/95
2015/0252530 A1 * 9/2015 Higuchi ..... D21F 1/526 162/363
2015/0275429 A1 * 10/2015 Higuchi ..... D21F 11/00 162/261
2015/0275430 A1 * 10/2015 Higuchi ..... D21F 9/04 162/261
2015/0275435 A1 * 10/2015 Seki ..... D21H 17/20 162/5
2015/0292153 A1 * 10/2015 Miyazawa ..... B27N 3/04 162/261
2016/0053435 A1 * 2/2016 Oguchi ..... D21B 1/063 162/198
2016/0121564 A1 * 5/2016 Oguchi ..... D04H 1/732 264/40.4
2016/0168794 A1 * 6/2016 Tsujino ..... D21F 11/00 162/198
2016/0168795 A1 * 6/2016 Fujita ..... D21F 9/00 162/261
2016/0186379 A1 * 6/2016 Hirata ..... D21B 1/08 162/202
2016/0229129 A1 * 8/2016 Ueno ..... B29B 7/38
2016/0230338 A1 * 8/2016 Nakamura ..... B07B 13/16
2016/0236380 A1 * 8/2016 Fujita ..... D21F 9/00
2016/0258112 A1 * 9/2016 Gomi ..... D21B 1/10
2016/0305066 A1 * 10/2016 Miyazawa ..... D04H 1/26
2016/0312405 A1 * 10/2016 Murayama ..... D21B 1/10
2016/0332325 A1 * 11/2016 Murayama ..... B27N 3/04
2017/0001330 A1 1/2017 Oguchi et al.
2017/0037550 A1 * 2/2017 Miyazawa ..... D04H 1/26
2017/0260691 A1 * 9/2017 Murayama ..... B65H 5/24
2017/0300042 A1 * 10/2017 Pauly ..... G06F 16/9535
2017/0312996 A1 * 11/2017 Murayama ..... D21B 1/08
2018/0314215 A9 * 11/2018 Sangi ..... G05B 13/021
2018/0319038 A1 * 11/2018 Nagai ..... B27N 1/029
2018/0347115 A1 * 12/2018 Oguchi ..... D04H 1/60
2018/0355556 A1 * 12/2018 Gomi ..... D21B 1/063
2018/0356805 A1 * 12/2018 Krishna ..... G05B 19/0428
2019/0062996 A1 * 2/2019 Yoda ..... D21F 9/046
2019/0100877 A1 * 4/2019 Oguchi ..... D21F 9/00
2019/0193296 A1 * 6/2019 Mikoshiba ..... D04H 1/413
2019/0218713 A1 * 7/2019 Oguchi ..... D21D 5/06
2019/0218714 A1 * 7/2019 Oguchi ..... D21G 9/0027
2019/0264393 A1 * 8/2019 Taniguchi ..... D04H 1/60
2019/0270220 A1 * 9/2019 Oguchi ..... D04H 1/60
2020/0101637 A1 * 4/2020 Yoda ..... D04H 1/732
2020/0140217 A1 * 5/2020 Fukasawa ..... B65H 35/008
2020/0141059 A1 * 5/2020 Inaba ..... D21G 9/0009
2020/0149219 A1 * 5/2020 Nakata ..... D21B 1/10
2020/0208348 A1 * 7/2020 Yamada ..... D21F 7/006
2021/0047779 A1 * 2/2021 Oguchi ..... D21F 13/00
2021/0277602 A1 * 9/2021 Oguchi ..... D21F 9/00
2021/0292970 A1 * 9/2021 Oguchi ..... D21H 23/20
2021/0292971 A1 * 9/2021 Gomi ..... D21B 1/061

FOREIGN PATENT DOCUMENTS

EP 3508635 A1 * 7/2019 ..... D04H 1/732
JP 2012140738 A * 7/2012 ..... D21F 7/06
JP 2015-155180 A 8/2015
JP 2015-182225 A 10/2015
JP 2016-129996 A 7/2016
JP 2016-172363 A 9/2016
JP 6573036 B2 * 9/2019 ..... B27N 3/04
JP 6787403 B2 * 11/2020 ..... G06F 3/0481
WO WO-2017094514 A1 * 6/2017 ..... D21G 9/0009

* cited by examiner

SHEET MANUFACTURING APPARATUS AND CONTROL METHOD FOR SHEET MANUFACTURING APPARATUS

CROSS-REFERENCE TO RELATED APPLICATIONS

This application is a U.S. National stage application of International Patent Application No. PCT/JP2017/028286, filed on Aug. 3, 2017, which claims priority under 35 U.S.C. § 119(a) to Japanese Patent Application No. 2016-169471, filed in Japan on Aug. 31, 2016. The entire disclosure of Japanese Patent Application No. 2016-169471 is hereby incorporated herein by reference.

TECHNICAL FIELD

The present invention relates to a sheet manufacturing apparatus and a control method for a sheet manufacturing apparatus.

BACKGROUND ART

In the related art, there has been an example in which a so-called humid type method of putting a raw material including fibers into water, performing defibration by mainly a mechanical effect, and performing screening is employed in a sheet manufacturing apparatus. Such a sheet manufacturing apparatus using the humid type method needs a large amount of water, and the size of the apparatus is increased. Furthermore, maintenance of a water processing facility requires effort, and the amount of energy related to a drying step is increased. Therefore, for a reduction in size and energy conservation, a sheet manufacturing apparatus of a dry type that does not use water as much as possible has been suggested.

In Japanese Unexamined Patent Application Publication No. 2015-182225, a control for reducing the amount of time until a stoppage of the apparatus in the case of stopping the dry type sheet manufacturing apparatus by performing the stoppage in a state where defibrated matter is retained inside is disclosed.

In a case where a dry type sheet manufacturing apparatus is stopped, it is preferable that not only defibrated matter be retained inside, but also a course or a timing of stopping operations of each unit of the apparatus is appropriately set. However, for example, a control for each unit in a case where the sheet manufacturing apparatus is stopped is not disclosed in detail in Japanese Unexamined Patent Application Publication No. 2015-182225.

SUMMARY

An object of the present invention is to set an appropriate course or an appropriate timing of stopping operations of each unit of an apparatus in a case where a sheet manufacturing apparatus is stopped.

In order to resolve the above problem, the present invention includes a defibrating unit that defibrates a raw material including fibers in an atmosphere, an accumulating unit that includes a drum in which a plurality of openings are formed, and discharges defibrated matter defibrated by the defibrating unit by causing the defibrated matter to pass through the openings by rotating the drum, a web forming unit that includes a belt on which the defibrated matter passing through the openings is accumulated, and forms a web by operating the belt, a sheet forming unit that forms a sheet from the web formed by the web forming unit, a cutter unit that cuts the sheet formed by the sheet forming unit into a preset size, and a control unit that executes a stop control with a cut operation of the cutter unit as a trigger in a case where an instruction to stop the apparatus is provided, in which in the stop control, the control unit stops operation of the defibrating unit after stopping rotation of the drum and movement of the belt.

According to the present invention, a series of controls for stopping the sheet manufacturing apparatus is executed with the operation of cutting the sheet by the cutter unit as a trigger. In the stop control, an operation of defibrating the raw material by the defibrating unit is executed even after the belt and the drum are stopped. Then, the defibrating unit is stopped. Thus, the sheet manufacturing apparatus stops in a state where the defibrated matter is supplied from the defibrating unit. Accordingly, in a case where the sheet manufacturing apparatus is stopped, since the leading edge part of the sheet can be stopped at an appropriate position, winding of the sheet onto the transport roller or sticking of the sheet at the time of a stoppage or the time of rebooting can be reduced. In addition, the sheet manufacturing apparatus can be stopped in a state where the defibrated matter remains inside the sheet manufacturing apparatus. At the time of next booting, supply of the defibrated matter to the web forming unit is quickly initiated, and manufacturing of the sheet can be initiated. Accordingly, the timing of stopping the cutter unit, the drum, the belt, and the defibrating unit in a case where the sheet manufacturing apparatus is stopped can be appropriately set.

In addition, in the present invention, in the stop control, for a predetermined time, the control unit executes a control for decreasing an operating speed of the defibrating unit from a speed in a normal operation before the stop control and then, stops the defibrating unit.

According to the present invention, the defibrating unit can be smoothly stopped. For example, in a configuration in which the defibrating unit includes a rotor that rotates at a high speed, a malfunction or exhaustion caused by suddenly stopping the defibrating unit can be prevented, and the sheet manufacturing apparatus that stably operates can be implemented.

In addition, the present invention further includes a selecting unit that selects the defibrated matter defibrated by the defibrating unit as first selected matter and second selected matter, and a separating unit that includes a separating belt on which the first selected matter selected by the selecting unit is accumulated, and separates the first selected matter by operating the separating belt, in which the control unit operates the separating belt for at least a preset time from initiation of a decrease in the operating speed of the defibrating unit.

According to the present invention, since the defibrated matter that is defibrated while the defibrating unit decelerates can be separated by the separating unit, the sheet manufacturing apparatus can be stopped in a state where an appropriate amount of the defibrated matter is present in the separating unit without excessively accumulating the defibrated matter in the separating unit.

In addition, the present invention further includes a grinding unit that grinds the raw material and supplies the raw material to the defibrating unit, in which the control unit stops supply of the raw material to the defibrating unit from the grinding unit at a timing of initiating deceleration of the defibrating unit.

According to the present invention, the amount of the raw material accumulated inside the defibrating unit in a case where the defibrating unit is stopped can be decreased. Accordingly, an increase in load at the time of rebooting or a discharge of a non-defibrated material at the time of rebooting can be prevented. In addition, by stopping supply of the raw material in a state where the performance of the defibration process is decreased by decelerating the defibrating unit, a decrease in the quality of the defibrated matter can be prevented.

In addition, in the present invention, the control unit sets a movement speed of the separating belt to a speed lower than the speed in the normal operation before the stop control while the operating speed of the defibrating unit is decreased.

According to the present invention, even in a case where the amount of supply of the defibrated matter is reduced by a decrease in the performance of the defibration process caused by deceleration of the defibrating unit, a sufficient amount of the first selected matter can be accumulated on the separating belt. Thus, the occurrence of variation in the amount of accumulation on the separating belt can be avoided, and the quality of the sheet manufactured in the case of the next start can be stabilized.

In addition, in the present invention, the separating belt is configured with a mesh belt, the present invention further includes a separation drawing unit that draws the separating belt in order to accumulate the first selected matter, and the control unit operates the separation drawing unit while the separating belt moves.

According to the present invention, the first selected matter can be quickly accumulated on the separating belt. Accordingly, a fault caused by floating first selected matter not being accumulated on the separating belt, insufficiency of fibers on the separating belt, and the like can be prevented, and the quality of the sheet can be stabilized.

In addition, the present invention further includes a resin supply unit that includes an openable and closable discharge unit and supplies resin from the discharge unit, and a mixing unit that mixes the resin supplied by the resin supply unit with the first selected matter separated by the separating unit in the atmosphere, in which a mixture that is mixed by the mixing unit is introduced into the drum, and in the stop control, the control unit performs a control for stopping supply of the resin from the resin supply unit in accordance with a timing of stopping the rotation of the drum and the movement of the belt and then, closing the discharge unit.

According to the present invention, by stopping supply of the resin in accordance with the timing of stopping the drum and the belt and closing the discharge unit, unnecessary movement of resin during a stoppage of the sheet manufacturing apparatus is prevented. Accordingly, imbalance of the amount of resin inside the apparatus, insufficiency of resin, or excessive accumulation of the mixture can be prevented, and the quality of the sheet manufactured in a case where the sheet manufacturing apparatus is started for the next time can be stabilized. In the following description, "matching timings" is not limited to matching all timings to the same timing. Matching timings means synchronization and includes a case where a slight difference occurs before and after timings.

In addition, in the present invention, the sheet forming unit includes a roller that pinches and presses the sheet formed by the web forming unit, and in the stop control, the control unit stops rotation of the roller in accordance with a timing of stopping the movement of the belt included in the web forming unit.

According to the present invention, since rotation of the roller is stopped in accordance with the timing at which the belt stops movement of the web, trouble such as sticking of the web can be prevented. In addition, in a case where the sheet manufacturing apparatus is started for the next time, manufacturing of the sheet can be quickly initiated.

In addition, in order to resolve the above problem, in a stop control for stopping a sheet manufacturing apparatus including a defibrating unit that defibrates a raw material including fibers in an atmosphere, an accumulating unit that includes a drum in which a plurality of openings are formed, and discharges defibrated matter defibrated by the defibrating unit by causing the defibrated matter to pass through the openings by rotating the drum, a web forming unit that includes a belt on which the defibrated matter passing through the openings is accumulated, and forms a web by operating the belt, a sheet forming unit that forms a sheet from the web formed by the web forming unit, and a cutter unit that cuts the sheet formed by the sheet forming unit into a preset size, the present invention performs stopping operation of the defibrating unit after stopping rotation of the drum and movement of the belt.

According to the present invention, a series of controls for stopping the sheet manufacturing apparatus is executed with the operation of cutting the sheet by the cutter unit as a trigger. In the stop control, an operation of defibrating the raw material by the defibrating unit is executed even after the belt and the drum are stopped. Then, the defibrating unit is stopped. Thus, the sheet manufacturing apparatus stops in a state where the defibrated matter is supplied from the defibrating unit. Accordingly, in a case where the sheet manufacturing apparatus is stopped, since the leading edge part of the sheet can be stopped at an appropriate position, winding of the sheet onto the transport roller or sticking of the sheet at the time of a stoppage or the time of rebooting can be reduced. In addition, the sheet manufacturing apparatus can be stopped in a state where the defibrated matter remains inside the sheet manufacturing apparatus. At the time of next booting, supply of the defibrated matter to the web forming unit is quickly initiated, and manufacturing of the sheet can be initiated. Accordingly, the timing of stopping the cutter unit, the drum, the belt, and the defibrating unit in a case where the sheet manufacturing apparatus is stopped can be appropriately set.

The present invention can be implemented in various forms other than the sheet manufacturing apparatus and the control method for the sheet manufacturing apparatus described above. For example, a system that includes the sheet manufacturing apparatus can be configured. In addition, a program executed by a computer may be implemented in order to execute the control method for the sheet manufacturing apparatus. In addition, the control method can be implemented in the form of a recording medium on which the program is recorded, a server apparatus that distributes the program, a transmission medium for transmitting the program, a data signal in which the program is implemented in a carrier wave, or the like.

DESCRIPTION OF EMBODIMENTS

Hereinafter, an exemplary embodiment of the present invention will be described in detail using the drawings. The embodiment described below does not limit the content of the invention disclosed in the claims. In addition, not all configurations described below are essential constituents of the present invention.

Figure 1:
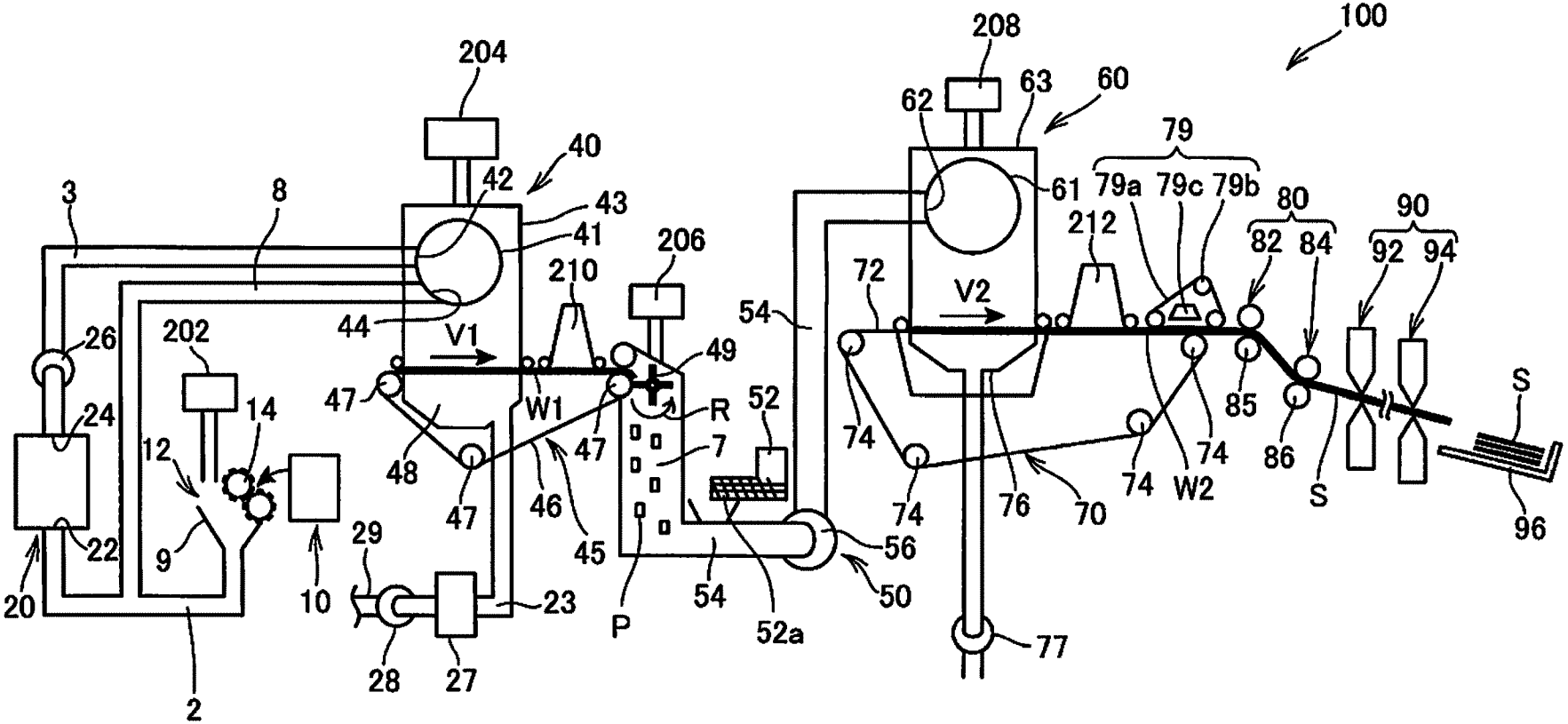
FIG. 1 is a schematic diagram illustrating a configuration of a sheet manufacturing apparatus.

FIG. 1 is a schematic diagram illustrating a configuration of a sheet manufacturing apparatus according to the embodiment.

A sheet manufacturing apparatus 100 according to the present embodiment is an apparatus suitable for manufacturing new paper by turning old used paper such as confidential paper as a raw material into fibers using dry type defibration and then, performing pressing, heating, and cutting. By mixing various additives to the raw material that has been turned into fibers, the binding strength or the brightness of paper products may be improved, or functions such as color, scent, and flame retardance may be added, depending on the application. In addition, molding by controlling the density, the thickness, and the shape of the paper enables paper of various thicknesses and sizes such as A4 or A3 office paper and business card paper to be manufactured depending on the application.

As illustrated in FIG. 1, the sheet manufacturing apparatus 100 includes a supply unit 10, a grinding unit 12, a defibrating unit 20, a selecting unit 40, a first web forming unit 45, a rotating body 49, a mixing unit 50, an accumulating unit 60, a second web forming unit 70, a transport unit 79, a sheet forming unit 80, and a cutting unit 90.

In addition, the sheet manufacturing apparatus 100 includes humidifying units 202, 204, 206, 208, 210, and 212 for humidifying the raw material and/or humidifying a space in which the raw material moves. Specific configurations of the humidifying units 202, 204, 206, 208, 210, and 212 are not limited and are exemplified by a steam type, a vaporization type, a warm air vaporization type, and an ultrasonic type.

In the present embodiment, the humidifying units 202, 204, 206, and 208 are configured with vaporization type or warm air vaporization type humidifiers. That is, the humidifying units 202, 204, 206, and 208 include a filter (not illustrated) through which water permeates, and supply humidified air having increased humidity by causing air to pass through the filter.

In addition, in the present embodiment, the humidifying unit 210 and the humidifying unit 212 are configured with ultrasonic type humidifiers. That is, the humidifying units 210 and 212 include a vibrating unit (not illustrated) that atomizes water, and supply mist generated by the vibrating unit.

The supply unit 10 supplies the raw material to the grinding unit 12. The raw material from which the sheet manufacturing apparatus 100 manufactures a sheet may be any raw material including fibers. The raw material is exemplified by, for example, paper, pulp, a pulp sheet, fabric including non-woven fabric, or cloth. In the present embodiment, a configuration in which the sheet manufacturing apparatus 100 uses old paper as the raw material is illustrated. The present embodiment is configured such that the supply unit 10 includes a stacker that accumulates old paper in an overlaid manner, and old paper is sent to the grinding unit 12 from the stacker by the operation of a paper feeding motor 315 (FIG. 2) described below.

The grinding unit 12 cuts (grinds) the raw material supplied by the supply unit 10 into ground pieces using a grinding blade 14. The grinding blade 14 cuts the raw material in a gas such as in the atmosphere (in the air). The grinding unit 12 includes, for example, a pair of grinding blades 14 that cut the raw material pinched therebetween, and a drive unit that rotates the grinding blades 14. The grinding unit 12 can have the same configuration as a so-called shredder. The shape and the size of the ground piece are not limited and may be any shape and any size suitable for a defibration process in the defibrating unit 20. For example, the grinding unit 12 cuts the raw material into paper pieces, each of which has a size of 1 to a few cm or less on each of its four edges.

The grinding unit 12 includes a chute (hopper) 9 that receives falling ground pieces cut by the grinding blades 14. For example, the chute 9 has a tapered shape that has a gradually decreasing width in a flow direction (traveling direction) of the ground pieces. Thus, the chute 9 can receive many ground pieces. A pipe 2 that communicates with the defibrating unit 20 is connected to the chute 9. The pipe 2 forms a transport path for transporting the raw material (ground pieces) cut by the grinding blades 14 to the defibrating unit 20. The ground pieces are collected by the chute 9 and are transferred (transported) to the defibrating unit 20 through the pipe 2.

Humidified air is supplied by the humidifying unit 202 to the chute 9 included in the grinding unit 12 or to the vicinity of the chute 9. Accordingly, a phenomenon in which the ground matter cut by the grinding blades 14 is adsorbed on the inner surface of the chute 9 or the pipe 2 by static electricity can be inhibited. In addition, the ground matter cut by the grinding blades 14 is transferred to the defibrating unit 20 along with the humidified (high humidity) air. Thus, the effect of inhibiting attachment of defibrated matter inside the defibrating unit 20 can also be expected. In addition, the humidifying unit 202 may be configured to supply humidified air to the grinding blades 14 and remove the electric charge of the raw material supplied by the supply unit 10. In addition, the electric charge may be removed using an ionizer along with the humidifying unit 202.

The defibrating unit 20 performs a defibration process on the raw material (ground pieces) cut by the grinding unit 12 and generates defibrated matter. The "defibration" means that the raw material (matter to be defibrated) of a plurality of bound fibers is separated fiber by fiber. The defibrating unit 20 has a function of separating a substance such as resin particles, ink, toner, or an antismear agent attached to the raw material from fiber.

The raw material that has passed through the defibrating unit 20 is referred to as "defibrated matter". The "defibrated matter" may include not only the separated fibers of the defibrated matter but also resin (resin for binding the plurality of fibers together) particles separated from the fibers in the case of separating the fibers, colorant such as ink and toner, and additives such as an antismear agent, and a paper strengthening agent. The shape of the separated defibrated matter is a string shape or a ribbon shape. The separated defibrated matter may be present in a non-tangled state (independent state) with other separated fibers or may be present in a tangled state (a state where a so-called "lump" is formed) with other separated defibrated matter as a clump shape.

The defibrating unit 20 performs dry type defibration. The dry type refers to a process such as defibration performed in a gas such as in the atmosphere (in the air) and not in a liquid. The present embodiment is configured such that the defibrating unit 20 uses impeller milling. Specifically, the defibrating unit 20 includes a rotor (not illustrated) that rotates at a high speed, and a liner (not illustrated) that is positioned on the outer circumference of a roller. The ground pieces ground by the grinding unit 12 are pinched and defibrated between the rotor and the liner of the defibrating unit 20. The defibrating unit 20 generates an airflow by rotating the rotor. This airflow enables the defibrating unit 20 to draw the ground pieces, which are the raw material, from the pipe 2 and transport the defibrated matter to a discharge port 24. The defibrated matter is sent to a pipe 3 from the discharge port 24 and is transferred to the selecting unit 40 through the pipe 3.

In such a manner, the defibrated matter generated by the defibrating unit 20 is transported to the selecting unit 40 from the defibrating unit 20 by the airflow generated by the defibrating unit 20. Furthermore, in the present embodiment, the sheet manufacturing apparatus 100 includes a defibrating unit blower 26 that is an airflow generating device. The defibrated matter is transported to the selecting unit 40 by an airflow generated by the defibrating unit blower 26. The defibrating unit blower 26 is attached to the pipe 3, draws air along with the defibrated matter from the defibrating unit 20, and blows air to the selecting unit 40.

The selecting unit 40 includes an introduction port 42 into which the defibrated matter defibrated by the defibrating unit 20 flows from the pipe 3 along with the airflow. The selecting unit 40 selects the defibrated matter introduced into the introduction port 42 by the length of fiber. Specifically, the selecting unit 40 selects the defibrated matter of a predetermined size or less as first selected matter and the defibrated matter larger than the first selected matter as second selected matter from the defibrated matter defibrated by the defibrating unit 20. The first selected matter includes fibers or particles or the like, and the second selected matter includes, for example, large fibers, non-defibrated pieces (ground pieces that are not sufficiently defibrated), and a clump into which defibrated fibers cohere or are tangled.

In the present embodiment, the selecting unit 40 includes a drum unit (sieve unit) 41 and a housing unit (cover unit) 43 that contains the drum unit 41.

The drum unit 41 is a cylindrical sieve that is rotationally driven by a motor. The drum unit 41 includes a net (a filter or a screen) and functions as a sieve (sifter). By the mesh of the net, the drum unit 41 selects the first selected matter smaller than the size of the mesh (opening) of the net and the second selected matter larger than the mesh of the net. For example, a metal net, expanded metal made by stretching a notched metal plate, or perforated metal made by forming holes in a metal plate using a press or the like can be used as the net of the drum unit 41.

The defibrated matter introduced into the introduction port 42 is sent into the drum unit 41 along with the airflow, and the first selected matter falls downward from the mesh of the net of the drum unit 41 by rotation of the drum unit 41. The second selected matter that cannot pass through the mesh of the net of the drum unit 41 is caused to flow and be guided to the discharge port 44 by an airflow that flows into the drum unit 41 from the introduction port 42, and is sent to a pipe 8.

The pipe 8 connects the inside of the drum unit 41 and the pipe 2. The second selected matter that flows through the pipe 8 flows through the pipe 2 along with the ground pieces ground by the grinding unit 12 and is guided to an introduction port 22 of the defibrating unit 20. Accordingly, the second selected matter is returned to the defibrating unit 20 and is subjected to the defibration process.

In addition, the first selected matter selected by the drum unit 41 scatters in the air through the mesh of the net of the drum unit 41 and falls toward a mesh belt 46 of the first web forming unit 45 that is positioned below the drum unit 41.

The first web forming unit 45 (separating unit) includes the mesh belt 46 (separating belt), a stretching roller 47, and a drawing unit (suction mechanism) 48. The mesh belt 46 is a belt of an endless shape, is suspended on three stretching rollers 47, and is transported in a direction illustrated by an arrow in the drawing by the motion of the stretching rollers 47. The surface of the mesh belt 46 is configured with a net in which openings of a predetermined size are lined up. In the first selected matter falling from the selecting unit 40, minute particles of a size that passes through the mesh of the net fall below the mesh belt 46. Fibers of a size that cannot pass through the mesh of the net are accumulated on the mesh belt 46 and are transported in the direction of the arrow along with the mesh belt 46. The minute particles falling from the mesh belt 46 include relatively small or less dense defibrated matter (resin particles, colorant, additives, and the like) and are removed matter that is not used in manufacturing of a sheet S by the sheet manufacturing apparatus 100.

The mesh belt 46 moves at a constant speed V1 during a normal operation of manufacturing the sheet S. The normal operation refers to an operation except for execution of a start control and a stop control, described below, for the sheet manufacturing apparatus 100. More specifically, the normal operation refers to a period in which the sheet manufacturing apparatus 100 is manufacturing the sheet S of desired quality.

Accordingly, the defibrated matter subjected to the defibration process by the defibrating unit 20 is selected as the first selected matter and the second selected matter by the selecting unit 40, and the second selected matter is returned to the defibrating unit 20. In addition, the removed matter is removed from the first selected matter by the first web forming unit 45. The residue after the removed matter is removed from the first selected matter is a material suitable for manufacturing of the sheet S. This material is accumulated on the mesh belt 46 and forms a first web W1.

The drawing unit 48 draws air from a space below the mesh belt 46. The drawing unit 48 is connected to a dust collecting unit 27 through a pipe 23. The dust collecting unit 27 is a filter type or cyclone type dust collecting device and separates minute particles from the airflow. A capturing blower 28 (separation drawing unit) is installed downstream of the dust collecting unit 27. The capturing blower 28 draws air from the dust collecting unit 27. In addition, air discharged by the capturing blower 28 is discharged outside the sheet manufacturing apparatus 100 through a pipe 29.

In such a configuration, air is drawn by the capturing blower 28 from the drawing unit 48 through the dust collecting unit 27. In the drawing unit 48, minute particles passing through the mesh of the net of the mesh belt 46 are drawn along with air and are sent to the dust collecting unit 27 through the pipe 23. The dust collecting unit 27 separates minute particles passing through the mesh belt 46 from the airflow and accumulates the minute particles.

Accordingly, fibers acquired after removing the removed matter from the first selected matter are accumulated on the mesh belt 46 and form the first web W1. The drawing performed by the capturing blower 28 promotes formation of the first web W1 on the mesh belt 46 and causes the removed matter to be quickly removed.

Humidified air is supplied to a space including the drum unit 41 by the humidifying unit 204. This humidified air humidifies the first selected matter inside the selecting unit 40. Accordingly, attachment of the first selected matter to the mesh belt 46 by static electricity can be weakened, and the first selected matter can be easily peeled from the mesh belt 46. Furthermore, attachment of the first selected matter to the inner wall of the rotating body 49 or the housing unit 43 by static electricity can be inhibited. In addition, the removed matter can be efficiently drawn by the drawing unit 48.

In the sheet manufacturing apparatus 100, a configuration in which the first selected matter and the second selected matter are selected and separated is not limited to the selecting unit 40 including the drum unit 41. For example, a configuration in which the defibrated matter subjected to the defibration process by the defibrating unit 20 is classified by a classifier may be employed. For example, a cyclone classifier, an elbow jet classifier, or an eddy classifier can be used as the classifier. In a case where such a classifier is used, the first selected matter and the second selected matter can be selected and separated. Furthermore, a configuration in which the removed matter including relatively small or less dense defibrated matter (resin particles, colorant, additives, and the like) is separated and removed can be implemented by the classifier. For example, a configuration in which minute particles included in the first selected matter are removed from the first selected matter by the classifier may be used. In this case, for example, a configuration in which the second selected matter is returned to the defibrating unit 20, the removed matter is collected by the dust collecting unit 27, and the first selected matter except for the removed matter is sent to a pipe 54 can be used.

In the transport path of the mesh belt 46, air including mist is supplied on the downstream side of the selecting unit 40 by the humidifying unit 210. The mist that is minute particles of water generated by the humidifying unit 210 falls toward the first web W1 and supplies moisture to the first web W1. Accordingly, the amount of moisture included in the first web W1 is adjusted, and attachment or the like of the fibers to the mesh belt 46 by static electricity can be inhibited.

The sheet manufacturing apparatus 100 includes the rotating body 49 that divides the first web W1 accumulated on the mesh belt 46. The first web W1 is peeled from the mesh belt 46 and is divided by the rotating body 49 at a position where the mesh belt 46 is folded by the stretching rollers 47.

The first web W1 is a soft material into which fibers are accumulated in a web shape. The rotating body 49 separates the fibers of the first web W1 and processes the first web W1 to be in a state where resin is easily mixed by a mixing unit 50 described below.

While the configuration of the rotating body 49 is not limited, the rotating body 49 in the present embodiment can have a rotating vane shape that includes a vane of a plate shape and rotates. The rotating body 49 is arranged at a position where the first web W1 peeled from the mesh belt 46 comes into contact with the vane. By rotation (for example, rotation in a direction illustrated by an arrow R in the drawing) of the rotating body 49, the vane hits and divides the first web W1 that is peeled from the mesh belt 46 and transported, and a subdivided body P is generated.

It is preferable that the rotating body 49 be installed at a position where the vane of the rotating body 49 does not hit the mesh belt 46. For example, the gap between the tip end of the vane of the rotating body 49 and the mesh belt 46 can be set to be greater than or equal to 0.05 mm and less than or equal to 0.5 mm. In this case, the first web W1 can be efficiently divided by the rotating body 49 without damaging the mesh belt 46.

The subdivided body P divided by the rotating body 49 falls inside a pipe 7 and is transferred (transported) to the mixing unit 50 by an airflow that flows inside the pipe 7.

In addition, humidified air is supplied to a space including the rotating body 49 by the humidifying unit 206. Accordingly, a phenomenon in which fiber is adsorbed to the inside the pipe 7 or the vane of the rotating body 49 by static electricity can be inhibited. In addition, since high humidity air is supplied to the mixing unit 50 through the pipe 7, the effect of static electricity can be inhibited in the mixing unit 50.

The mixing unit 50 includes an additive supply unit 52 that supplies an additive including resin, a pipe 54 that communicates with the pipe 7 and where the airflow including the subdivided body P flows, and a mixing blower 56 (transfer blower).

As described above, the subdivided body P is fiber acquired by removing the removed matter from the first selected matter that has passed through the selecting unit 40. The mixing unit 50 mixes the additive including resin with the fibers constituting the subdivided body P.

In the mixing unit 50, an airflow is generated by the mixing blower 56, and the subdivided body P and the additive are mixed and transported in the pipe 54. In addition, the subdivided body P is separated into finer fibrous shapes while flowing inside the pipe 7 and the pipe 54.

The additive supply unit 52 (resin containing unit) is connected to a resin cartridge (not illustrated) that accumulates the additive, and supplies the additive inside the resin cartridge to the pipe 54. The additive cartridge may be configured to be attachable and detachable with respect to the additive supply unit 52. In addition, a configuration in which the additive cartridge is refilled with the additive may be included. The additive supply unit 52 temporarily retains the additive consisting of minute powder or minute particles inside the resin cartridge. The additive supply unit 52 includes a discharge unit 52*a* (resin supply unit) that sends the temporarily retained additive to the pipe 54. The discharge unit 52*a* includes a feeder (not illustrated) that sends the additive retained in the additive supply unit 52 to the pipe 54, and a shutter (not illustrated) that opens and closes a duct connecting the feeder and the pipe 54. In a case where the shutter is closed, the duct or an opening that connects the discharge unit 52*a* and the pipe 54 is closed, and the supply of the additive to the pipe 54 from the additive supply unit 52 is stopped.

In a state where the feeder of the discharge unit 52*a* does not operate, the additive is not supplied to the pipe 54 from the discharge unit 52*a*. However, for example, in a case where a negative pressure is generated in the pipe 54, there is a possibility that the additive flows to the pipe 54 even in a case where the feeder of the discharge unit 52*a* is stopped. Such a flow of additive can be securely blocked by closing the discharge unit 52*a*.

The additive supplied by the additive supply unit 52 includes resin for binding a plurality of fibers. The resin is thermoplastic resin or thermosetting resin and is, for example, AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, or polyetheretherketone. Such resin may be used alone or may be appropriately mixed and used. That is, the additive may include a single substance, may be a mixture, or may include particles of a plurality of types, each of which is configured with a single or a plurality of substances. In addition, the additive may have a fibrous shape or a powdery shape.

The resin included in the additive is melted by heating and binds a plurality of fibers together. Accordingly, in a state where the resin is mixed with the fibers, and heating is not performed to a temperature at which the resin is melted, the fibers are not bound together.

In addition, the additive supplied by the additive supply unit 52 may include not only the resin binding the fibers but also colorant for coloring the fibers, a coherence inhibitor for inhibiting coherence of the fibers or coherence of the resin, and a flame retardant for making the fibers or the like not easily flammable depending on the type of sheet to be manufactured. In addition, the additive that does not include colorant may be colorless or thin such that the additive looks colorless, or may be white.

By the airflow generated by the mixing blower 56, the subdivided body P falling in the pipe 7 and the additive supplied by the additive supply unit 52 are drawn into the pipe 54 and pass through the mixing blower 56. The airflow generated by the mixing blower 56 and/or the effect of a rotating unit such as the vane included in the mixing blower 56 mixes the fibers constituting the subdivided body P with the additive, and the mixture (a mixture of the first selected matter and the additive) is transferred to the accumulating unit 60 through the pipe 54.

A mechanism that mixes the first selected matter with the additive is not particularly limited and may be such that stirring is performed by a vane that rotates at a high speed, rotation of a container is used such as a V type mixer, or such a mechanism is installed before or after the mixing blower 56.

The accumulating unit 60 introduces the mixture, which has passed through the mixing unit 50, from an introduction port 62, separates the tangled defibrated matter (fibers), and drops the separated fibers in a scattering manner in the air. Furthermore, in a case where the resin of the additive supplied from the additive supply unit 52 has a fibrous shape, the accumulating unit 60 separates the tangled resin. Accordingly, the accumulating unit 60 can uniformly accumulate the mixture on the second web forming unit 70.

The accumulating unit 60 includes a drum unit 61 (drum) and a housing unit (cover unit) 63 that contains the drum unit 61. The drum unit 61 is a cylindrical sieve that is rotationally driven by a motor. The drum unit 61 includes a net (a filter or a screen) and functions as a sieve (sifter). By the mesh of the net, the drum unit 61 causes a fiber or a particle smaller than the mesh (opening) of the net to pass and fall from the drum unit 61. For example, the configuration of the drum unit 61 is the same as the configuration of the drum unit 41.

The "sieve" of the drum unit 61 may not have a function of selecting specific target matter. That is, the "sieve" that is used as the drum unit 61 means that a net is included. The drum unit 61 may drop the whole mixture introduced in the drum unit 61.

The second web forming unit 70 is arranged below the drum unit 61. The second web forming unit 70 (web forming unit) forms a second web W2 (accumulated matter) by accumulating passed matter that has passed through the accumulating unit 60. The second web forming unit 70 includes, for example, a mesh belt 72 (belt), a stretching roller 74, and a suction mechanism 76.

The mesh belt 72 is a belt of an endless shape, is suspended on a plurality of stretching rollers 74, and is transported in a direction illustrated by an arrow in the drawing by the motion of the stretching rollers 74. The mesh belt 72 is made of, for example, metal, resin, fabric, or non-woven fabric. The surface of the mesh belt 72 is configured with a net in which openings of a predetermined size are lined up. Among the fibers or particles falling from the drum unit 61, minute particles of a size that passes through the mesh of the net fall below the mesh belt 72. Fibers of a size that cannot pass through the mesh of the net are accumulated on the mesh belt 72 and are transported in the direction of the arrow along with the mesh belt 72. In addition, the movement speed of the mesh belt 72 can be controlled by a control unit 150 (FIG. 2) described below. The mesh belt 72 moves at a constant speed V2 during the normal operation of manufacturing the sheet S. The normal operation is the same as described above.

The mesh of the net of the mesh belt 72 can have a minute size that does not cause most of the fibers or particles falling from the drum unit 61 to pass through.

The suction mechanism 76 is disposed below the mesh belt 72 (on the opposite side from the accumulating unit 60 side). The suction mechanism 76 includes a suction blower 77. A drawing force of the suction blower 77 can cause the suction mechanism 76 to generate an airflow directed downward (an airflow directed toward the mesh belt 72 from the accumulating unit 60).

The mixture that is scattered in the air by the accumulating unit 60 is drawn onto the mesh belt 72 by the suction mechanism 76. Accordingly, formation of the second web W2 on the mesh belt 72 is promoted, and the speed of discharge from the accumulating unit 60 can be increased. Furthermore, by the suction mechanism 76, a downflow can be formed in the falling path of the mixture, and tangling of the defibrated matter or the additive during falling can be prevented.

The suction blower 77 (accumulation drawing unit) may discharge air drawn from the suction mechanism 76 outside the sheet manufacturing apparatus 100 through a capturing filter not illustrated. Alternatively, the air drawn by the suction blower 77 may be sent into the dust collecting unit 27, and the removed matter included in the air drawn by the suction mechanism 76 may be captured.

Humidified air is supplied to a space including the drum unit 61 by the humidifying unit 208. The humidified air can humidify the inside of the accumulating unit 60, thereby inhibiting attachment of the fibers or particles to the housing unit 63 by static electricity and causing the fibers or particles to quickly fall onto the mesh belt 72. The second web W2 of a preferable shape can be formed.

In such a manner, the second web W2 in a soft and swollen state including a large amount of air is formed through the accumulating unit 60 and the second web forming unit 70 (web forming step). The second web W2 accumulated on the mesh belt 72 is transported to the sheet forming unit 80.

In the transport path of the mesh belt 72, air including mist is supplied on the downstream side of the accumulating unit 60 by the humidifying unit 212. Accordingly, mist generated by the humidifying unit 212 is supplied to the second web W2, and the amount of moisture included in the second web W2 is adjusted. Accordingly, attachment or the like of the fibers to the mesh belt 72 by static electricity can be inhibited.

In the sheet manufacturing apparatus 100, the transport unit 79 that transports the second web W2 on the mesh belt 72 to the sheet forming unit 80 is disposed. The transport unit 79 includes, for example, a mesh belt 79*a*, a stretching roller 79*b*, and a suction mechanism 79*c*.

The suction mechanism 79*c* includes an intermediate blower 79*d* (FIG. 2) and generates an airflow upward of the mesh belt 79*a* by the drawing force of the intermediate blower 79*d*. This airflow draws the second web W2, and the second web W2 is separated from the mesh belt 72 and is adsorbed onto the mesh belt 79*a*. The mesh belt 79*a* moves by rotation of the stretching roller 79*b* and transports the second web W2 to the sheet forming unit 80. For example, the movement speed of the mesh belt 72 is the same as the movement speed of the mesh belt 79*a*.

In such a manner, the transport unit 79 peels and transports the second web W2 formed on the mesh belt 72 from the mesh belt 72.

The sheet forming unit 80 molds the sheet S by pressing and heating the second web W2 accumulated on the mesh belt 72. In the sheet forming unit 80, a plurality of fibers in the mixture are bound to each other through the additive (resin) by heating the fibers of the defibrated matter and the additive included in the second web W2.

The sheet forming unit 80 includes a pressing unit 82 that presses the second web W2, and a heating unit 84 that heats the second web W2 pressed by the pressing unit 82.

Figure 2:
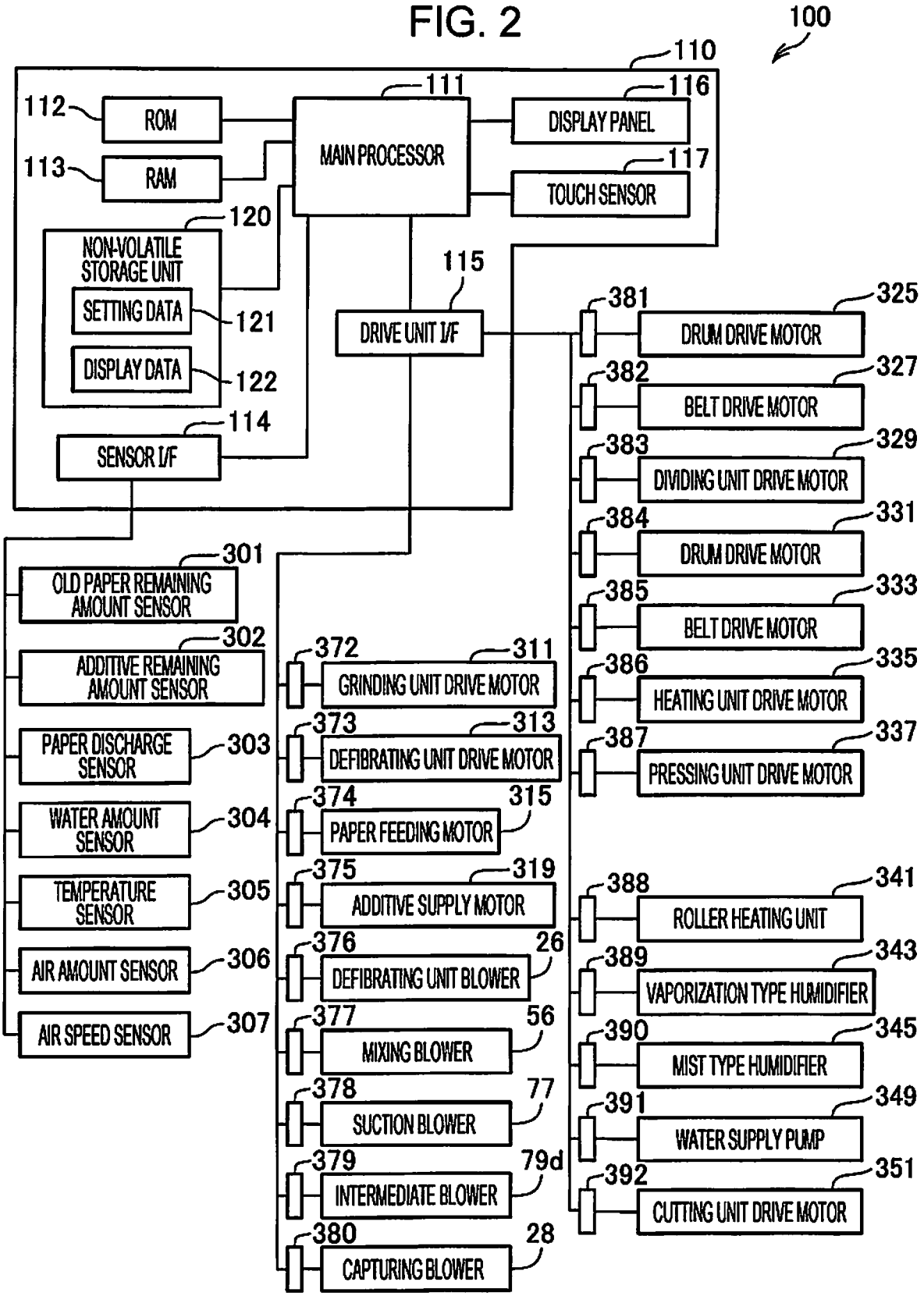
FIG. 2 is a block diagram illustrating a configuration of a control system of the sheet manufacturing apparatus.

The pressing unit 82 is configured with a pair of calender rollers 85 (roller) and presses the second web W2 by pinching at a predetermined nip pressure. By pressing, the thickness of the second web W2 is decreased, and the density of the second web W2 is increased. The pressing unit 82 includes a pressing unit drive motor 337 (FIG. 2). One of the pair of calender rollers 85 is a drive roller that is driven by the pressing unit drive motor 337, and the other is a driven roller. The calender rollers 85 rotate by the drive force of the pressing unit drive motor 337 and transport the second web W2 having high density after pressing toward the heating unit 84.

The heating unit 84 can be configured using, for example, a heating roller (heater roller), a heat press molding machine, a hotplate, a warm air blower, an infrared heater, or a flash fixer. In the present embodiment, the heating unit 84 includes a pair of heating rollers 86. The heating rollers 86 are heated to a preset temperature by a heater that is installed inside or outside the heating rollers 84*a* and 84*b*. The heating rollers 86 pinch and heat the second web W2 pressed by the calender rollers 85 and form the sheet S. The heating unit 84 includes a heating unit drive motor 335 (FIG. 2). One of the pair of heating rollers 86 is a drive roller that is driven by the heating unit drive motor 335, and the other is a driven roller. The heating rollers 86 rotate by the drive force of the heating unit drive motor 335 and transport the heated sheet S toward the cutting unit 90.

The number of calender rollers 85 included in the pressing unit 82 and the number of heating rollers 86 included in the heating unit 84 are not particularly limited.

The cutting unit 90 (cutter unit) cuts the sheet S formed by the sheet forming unit 80. In the present embodiment, the cutting unit 90 includes a first cutting unit 92 that cuts the sheet S in a direction intersecting with the transport direction of the sheet S, and a second cutting unit 94 that cuts the sheet S in a direction parallel to the transport direction. For example, the second cutting unit 94 cuts the sheet S that has passed through the first cutting unit 92.

In such a manner, a single cut sheet S of a predetermined size is molded. The single cut sheet S that is cut is discharged to a discharge unit 96. The discharge unit 96 includes a tray or a stacker on which the sheet S of a predetermined size is placed.

In the above configuration, the humidifying units 202, 204, 206, and 208 may be configured with one vaporization type humidifier. In this case, a configuration in which humidified air generated by one humidifier is separately supplied to the grinding unit 12, the housing unit 43, the pipe 7, and the housing unit 63 may be used. This configuration can be easily implemented by separately installing ducts (not illustrated) for supplying the humidified air. In addition, the humidifying units 202, 204, 206, and 208 can also be configured with two or three vaporization type humidifiers. In the present embodiment, humidified air is supplied to the humidifying units 202, 204, 206, and 208 from a vaporization type humidifier 343 (FIG. 2) as will be described below.

In addition, in the above configuration, the humidifying units 210 and 212 may be configured with one ultrasonic type humidifier or may be configured with two ultrasonic type humidifiers. For example, a configuration in which air that includes mist generated by one humidifier is separately supplied to the humidifying unit 210 and the humidifying unit 212 can be used. In the present embodiment, air including mist is supplied to the humidifying units 210 and 212 by a mist type humidifier 345 (FIG. 2) described below.

In addition, blowers included in the sheet manufacturing apparatus 100 are not limited to the defibrating unit blower 26, the capturing blower 28, the mixing blower 56, the suction blower 77, and the intermediate blower 79*d*. For example, a fan that assists each blower can also be disposed in a duct.

In addition, while the grinding unit 12 initially grinds the raw material, and the sheet S is manufactured from the ground raw material in the above configuration, a configuration, for example, in which the sheet S is manufactured using fibers as the raw material can be used.

For example, a configuration in which fibers equivalent to the defibrated matter subjected to the defibration process by the defibrating unit 20 can be put into the drum unit 41 as the raw material may be used. In addition, a configuration in which fibers equivalent to the first selected matter separated from the defibrated matter can be put into the pipe 54 as the raw material may be used. In this case, the sheet S can be manufactured by supplying fibers processed from old paper, pulp, and the like to the sheet manufacturing apparatus 100.

FIG. 2 is a block diagram illustrating a configuration of a control system of the sheet manufacturing apparatus 100.

The sheet manufacturing apparatus 100 includes a control device 110 that includes a main processor 111 controlling each unit of the sheet manufacturing apparatus 100.

The control device 110 includes the main processor 111, a read only memory (ROM) 112, and a random access memory (RAM) 113. The main processor 111 is an operation processing device such as a central processing unit (CPU) and controls each unit of the sheet manufacturing apparatus 100 by executing a basic control program stored in the ROM 112. The main processor 111 may be configured as a system chip that includes peripheral circuits such as the ROM 112 and the RAM 113 and other IP cores.

The ROM 112 stores the program executed by the main processor 111 in a non-volatile manner. The RAM 113 forms a work area used by the main processor 111 and temporarily stores the program executed by the main processor 111 and process target data.

A non-volatile storage unit 120 stores the program executed by the main processor 111 and data processed by the main processor 111. For example, the non-volatile storage unit 120 stores setting data 121 and display data 122. The setting data 121 includes data for setting the operation of the sheet manufacturing apparatus 100. For example, the setting data 121 includes data such as the characteristics of various sensors included in the sheet manufacturing apparatus 100 and a threshold used in a process in which the main processor 111 detects a malfunction based on the output values of various sensors. The display data 122 is screen data displayed on a display panel 116 by the main processor 111. The display data 122 may be static image data or may be data for setting a screen display that displays data generated or acquired by the main processor 111.

The display panel 116 is a display panel such as a liquid crystal display and, for example, is installed on the front surface of the sheet manufacturing apparatus 100. The display panel 116 displays the operating state, various setting values, an alert display, and the like of the sheet manufacturing apparatus 100 in accordance with control of the main processor 111.

A touch sensor 117 detects a touch (contact) operation or a press operation. For example, the touch sensor 117 is configured with a pressure sensitive type or an electrostatic capacitive type sensor including a transparent electrode and is arranged in an overlaid manner on the display surface of the display panel 116. In a case where the touch sensor 117 detects the operation, the touch sensor 117 outputs operation data including an operation position and the number of operation positions to the main processor 111. The main processor 111 detects the operation performed on the display panel 116 and acquires the operation position by the output of the touch sensor 117. The main processor 111 implements a graphical user interface (GUI) operation based on the operation position detected by the touch sensor 117 and the display data 122 being displayed on the display panel 116.

The control device 110 is connected through a sensor interface (I/F) 114 to a sensor that is installed in each unit of the sheet manufacturing apparatus 100. The sensor I/F 114 is an interface that acquires a detection value output by the sensor and inputs the detection value into the main processor 111. The sensor I/F 114 may include an analogue/digital (A/D) converter that converts an analog signal output by the sensor into digital data. In addition, the sensor I/F 114 may supply a drive current to each sensor. In addition, the sensor I/F 114 may include a circuit that acquires the output value of each sensor in accordance with a sampling frequency specified by the main processor 111 and outputs the output value to the main processor 111.

An old paper remaining amount sensor 301, an additive remaining amount sensor 302, a paper discharge sensor 303, a water amount sensor 304, a temperature sensor 305, an air amount sensor 306, and an air speed sensor 307 are connected to the sensor I/F 114.

The control device 110 is connected to each drive unit included in the sheet manufacturing apparatus 100 through a drive unit interface (I/F) 115. The drive units included in the sheet manufacturing apparatus 100 are a motor, a pump, a heater, and the like. As illustrated in FIG. 2, the drive unit I/F 115 is connected to each drive unit through drive integrated circuits (IC) 372 to 392. The drive ICs 372 to 392 are circuits that supply a drive current to the drive units in accordance with control of the main processor 111 and are configured with electric power semiconductor elements or the like. For example, the drive ICs 372 to 392 are drive circuits that drive inverter circuits or stepping motors. A specific configuration and specifications of each of the drive ICs 372 to 392 are appropriately selected depending on the connected drive unit.

Figure 3:
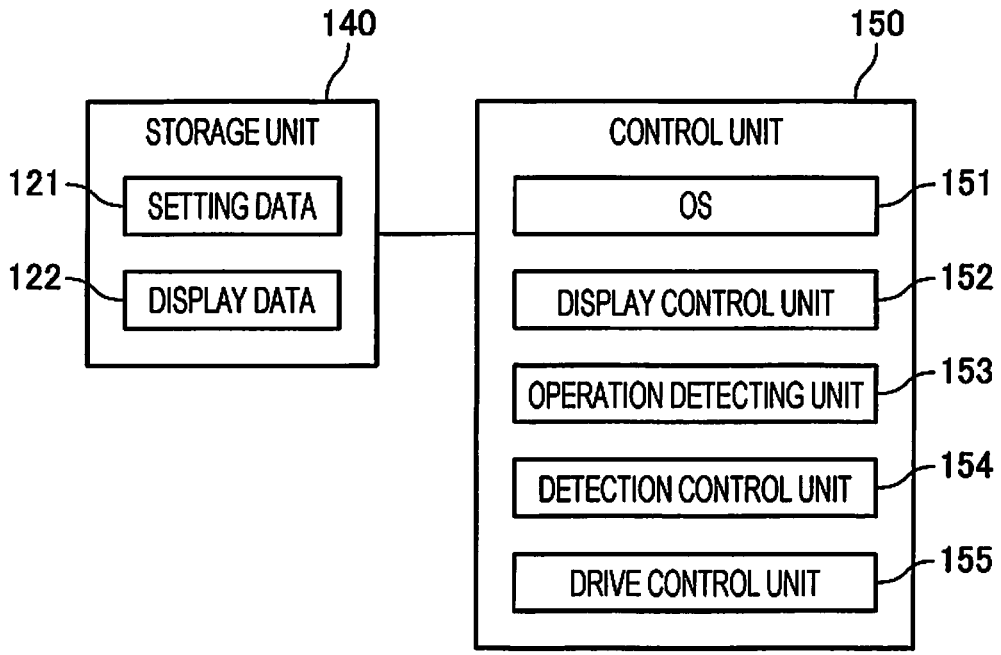
FIG. 3 is a function block diagram of a control unit and a storage unit.

FIG. 3 is a function block diagram of the sheet manufacturing apparatus 100 and illustrates a functional configuration of a storage unit 140 and the control unit 150. The storage unit 140 is a logical storage unit configured with the non-volatile storage unit 120 (FIG. 2) and may include the ROM 112.

The control unit 150 and various functional units included in the control unit 150 are formed in cooperation between software and hardware by causing the main processor 111 to execute the program. The hardware constituting the functional units is exemplified by, for example, the main processor 111, the ROM 112, the RAM 113, and the non-volatile storage unit 120.

The control unit 150 has the functions of an operating system (OS) 151, a display control unit 152, an operation detecting unit 153, a detection control unit 154, and a drive control unit 155.

The function of the operating system 151 is the function of a control program stored in the storage unit 140. Other units of the control unit 150 have the function of an application program that is executed on the operating system 151.

The display control unit 152 displays an image on the display panel 116 based on the display data 122.

The operation detecting unit 153 determines the content of the GUI operation corresponding to the detected operation position in a case where an operation performed on the touch sensor 117 is detected.

The detection control unit 154 acquires the detection values of various sensors connected to the sensor I/F 114. In addition, the detection control unit 154 performs a determination by comparing the output values of the sensors connected to the sensor I/F 114 with a preset threshold (setting value). In a case where the determination result corresponds to a condition for performing notification, the detection control unit 154 causes the display control unit 152 to perform notification based on an image or a text by outputting a notification content to the display control unit 152.

The drive control unit 155 controls the start (booting) and the stoppage of each drive unit connected through the drive unit I/F 115. In addition, the drive control unit 155 may be configured to control the number of rotations for the defibrating unit blower 26, the mixing blower 56, and the like.

Returning to FIG. 2, a grinding unit drive motor 311 is connected to the drive unit I/F 115 through the drive IC 372. The grinding unit drive motor 311 rotates a cutting blade (not illustrated) that cuts old paper which is the raw material.

A defibrating unit drive motor 313 is connected to the drive unit I/F 115 through the drive IC 373. The defibrating unit drive motor 313 rotates the rotor (not illustrated) included in the defibrating unit 20.

The paper feeding motor 315 is connected to the drive unit I/F 115 through the drive IC 374. The paper feeding motor 315 is attached to the supply unit 10 and drives a roller (not illustrated) that transports old paper. In a case where a drive current is supplied to the paper feeding motor 315 from the drive IC 374 by control of the control unit 150, and the paper feeding motor 315 operates, old paper that is the raw material accumulated by the supply unit 10 is sent to the grinding unit 12.

An additive supply motor 319 is connected to the drive unit I/F 115 through the drive IC 375. The additive supply motor 319 drives a screw feeder that sends the additive in the discharge unit 52*a*. In addition, the additive supply motor 319 is connected to the discharge unit 52*a* and opens and closes the discharge unit 52*a*.

In addition, the defibrating unit blower 26 is connected to the drive unit I/F 115 through the drive IC 376. Similarly, the mixing blower 56 is connected to the drive unit I/F 115 through the drive IC 377. In addition, the suction blower 77 is connected to the drive unit I/F 115 through the drive IC 378, and the intermediate blower 79*d* is connected to the drive unit I/F 115 through the drive IC 379. In addition, the capturing blower 28 is connected to the drive unit I/F 115 through the drive IC 380. Such a configuration enables the control device 110 to control the start and the stoppage of the defibrating unit blower 26, the mixing blower 56, the suction blower 77, the intermediate blower 79*d*, and the capturing blower 28. In addition, the control device 110 may be configured to be able to control the number of rotations of those blowers. In this case, for example, inverters may be used as the drive ICs 376 to 380.

A drum drive motor 325 is a motor that rotates the drum unit 41, and is connected to the drive unit I/F 115 through the drive IC 381.

A belt drive motor 327 is a motor that drives the mesh belt 46, and is connected to the drive unit I/F 115 through the drive IC 382.

A dividing unit drive motor 329 is a motor that rotates the rotating body 49, and is connected to the drive unit I/F 115 through the drive IC 383.

A drum drive motor 331 is a motor that rotates the drum unit 61, and is connected to the drive unit I/F 115 through the drive IC 384.

A belt drive motor 333 is a motor that drives the mesh belt 72, and is connected to the drive unit I/F 115 through the drive IC 385.

The heating unit drive motor 335 is a motor that drives the heating rollers 86 of the heating unit 84, and is connected to the drive unit I/F 115 through the drive IC 386.

The pressing unit drive motor 337 is a motor that drives the calender rollers 85 of the pressing unit 82, and is connected to the drive unit I/F 115 through the drive IC 387.

A roller heating unit 341 is a heater that heats the heating rollers 86. This heater may be installed inside the heating rollers 86 or may heat the heating rollers 86 from the outside of the heating rollers 86. The roller heating unit 341 is connected to the drive unit I/F 115 through the drive IC 388.

The vaporization type humidifier 343 is a device that includes a tank (not illustrated) retaining water and a filter (not illustrated) through which the water in the tank permeates, and performs humidification by sending air to the filter. The vaporization type humidifier 343 is connected to the drive unit I/F 115 through the drive IC 389 and switches sending of air to the filter ON/OFF in accordance with control of the control unit 150. In the present embodiment, humidified air is supplied to the humidifying units 202, 204, 206, and 208 from the vaporization type humidifier 343. Accordingly, the humidifying units 202, 204, 206, and 208 supply the humidified air supplied by the vaporization type humidifier 343 to the grinding unit 12, the selecting unit 40, the pipe 54, and the accumulating unit 60. The vaporization type humidifier 343 may be configured with a plurality of vaporization type humidifiers. In this case, a location where each vaporization type humidifier is installed may be any of the grinding unit 12, the selecting unit 40, the pipe 54, or the accumulating unit 60.

The mist type humidifier 345 includes a tank (not illustrated) that retains water, and a vibrating unit that generates atomized water droplets (mist) by exerting vibration to the water in the tank. The mist type humidifier 345 is connected to the drive unit I/F 115 through the drive IC 390 and switches the vibrating unit ON/OFF in accordance with control of the control unit 150. In the present embodiment, air including mist is supplied to the humidifying units 210 and 212 from the mist type humidifier 345. Accordingly, the humidifying units 210 and 212 supply air including mist supplied by the mist type humidifier 345 to each of the first web W1 and the second web W2.

A water supply pump 349 is a pump that draws water from the outside of the sheet manufacturing apparatus 100 and fills a tank (not illustrated) included inside the sheet manufacturing apparatus 100 with water. For example, in a case where the sheet manufacturing apparatus 100 is started, an operator who operates the sheet manufacturing apparatus 100 performs setting by pouring water into a water supply tank. The sheet manufacturing apparatus 100 operates the water supply pump 349 and fills the tank inside the sheet manufacturing apparatus 100 with water from the water supply tank. In addition, the water supply pump 349 may supply water to the vaporization type humidifier 343 and the mist type humidifier 345 from the tank of the sheet manufacturing apparatus 100.

A cutting unit drive motor 351 is a motor that drives the first cutting unit 92 and the second cutting unit 94 of the cutting unit 90. The cutting unit drive motor 351 is connected to the drive unit I/F 115 through the drive IC 392.

The old paper remaining amount sensor 301 is a sensor that detects the remaining amount of old paper which is the raw material supplied to the grinding unit 12. The old paper remaining amount sensor 301 detects the remaining amount of old paper contained in the supply unit 10 (FIG. 1). For example, the control unit 150 performs notification of insufficient old paper in a case where the remaining amount of old paper detected by the old paper remaining amount sensor 301 becomes below a setting value.

The additive remaining amount sensor 302 is a sensor that detects the remaining amount of the additive suppliable from the additive supply unit 52. The additive remaining amount sensor 302 detects the remaining amount of the additive in the additive cartridge connected to the additive supply unit 52. For example, the control unit 150 performs notification in a case where the remaining amount of the additive detected by the additive remaining amount sensor 302 becomes below a setting value.

The paper discharge sensor 303 detects the amount of the sheet S accumulated in the tray or the stacker included in the discharge unit 96. The control unit 150 performs notification in a case where the amount of the sheet S detected by the paper discharge sensor 303 becomes greater than or equal to a setting value.

The water amount sensor 304 is a sensor that detects the amount of water in the tank (not illustrated) incorporated in the sheet manufacturing apparatus 100. The control unit 150 performs notification in a case where the amount of water detected by the water amount sensor 304 becomes below a setting value. In addition, the water amount sensor 304 may also be configured to be able to detect the remaining capacity of the tank of the vaporization type humidifier 343 and/or the mist type humidifier 345.

The temperature sensor 305 detects the temperature of air flowing inside the sheet manufacturing apparatus 100. In addition, the air amount sensor 306 detects the air amount of air flowing inside the sheet manufacturing apparatus 100. In addition, the air speed sensor 307 detects the air speed of air flowing inside the sheet manufacturing apparatus 100. For example, the temperature sensor 305, the air amount sensor 306, and the air speed sensor 307 are installed in the pipe 29 through which air discharged by the capturing blower 28 flows, and detect the temperature, the air amount, and the air speed. The control unit 150 determines the state of the airflow inside the sheet manufacturing apparatus 100 based on the detection values of the temperature sensor 305, the air amount sensor 306, and the air speed sensor 307. The control unit 150 appropriately maintains the state of the airflow inside the sheet manufacturing apparatus 100 by controlling the number of rotations of the defibrating unit blower 26, the mixing blower 56, and the like based on the determination result.

Next, the operation of the sheet manufacturing apparatus 100 will be described.

Figure 4:
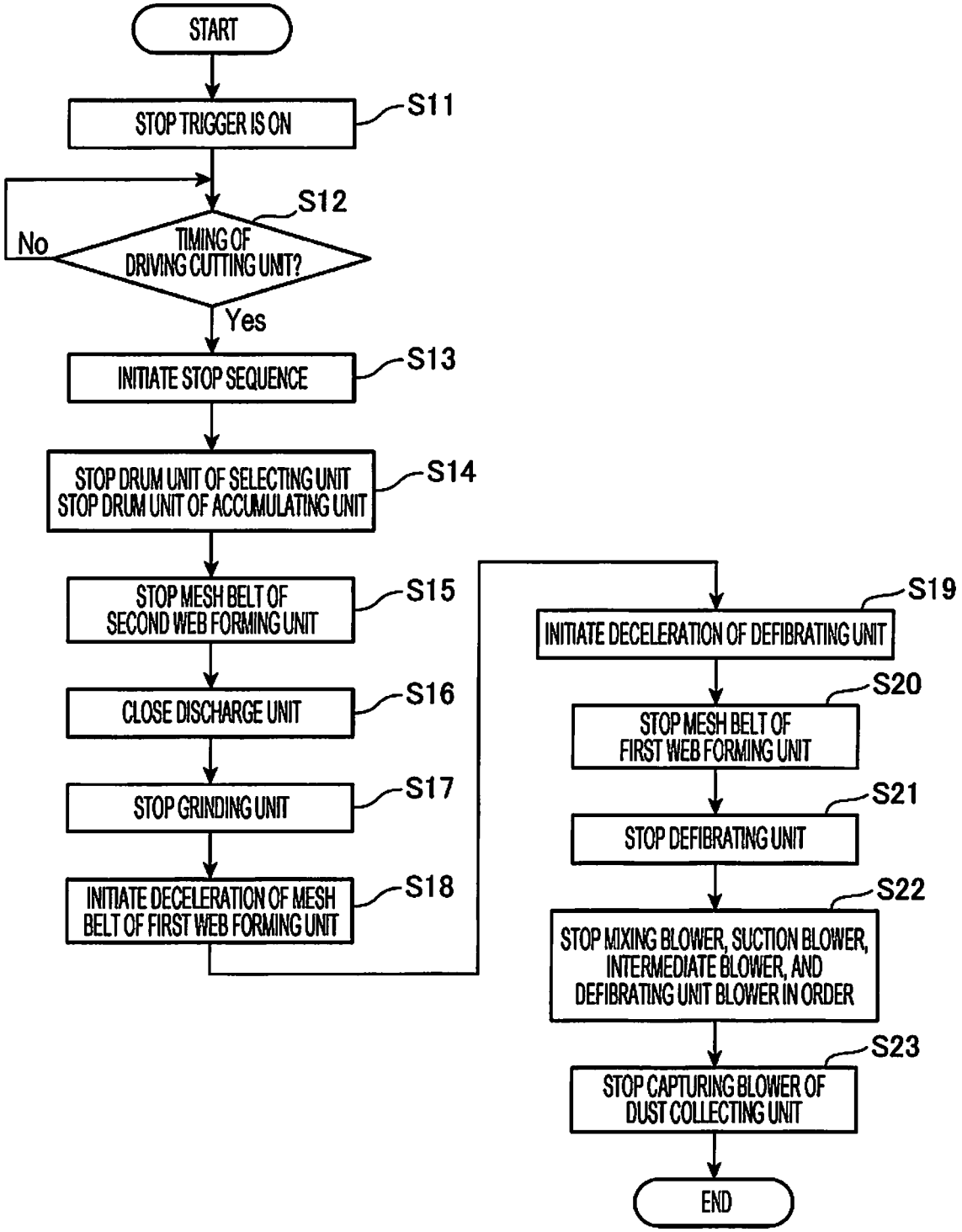
FIG. 4 is a flowchart illustrating an operation of the sheet manufacturing apparatus.

FIG. 4 is a flowchart illustrating the operation of the sheet manufacturing apparatus 100 and particularly, illustrates an operation of stopping the sheet manufacturing apparatus 100 by control of the control unit 150.

Figure 5:
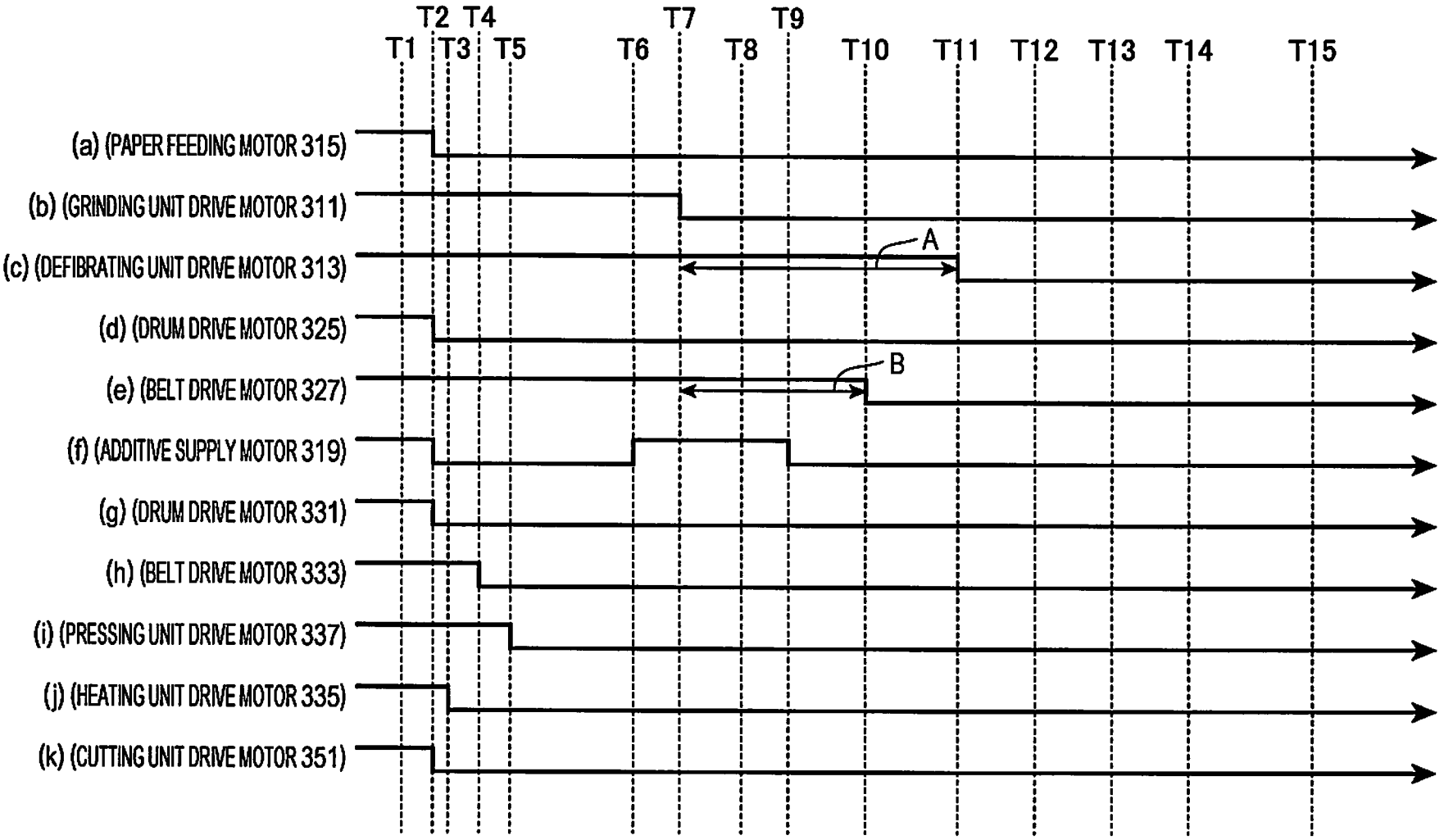
FIG. 5 is a timing chart illustrating the operation of the sheet manufacturing apparatus.
Figure 6:
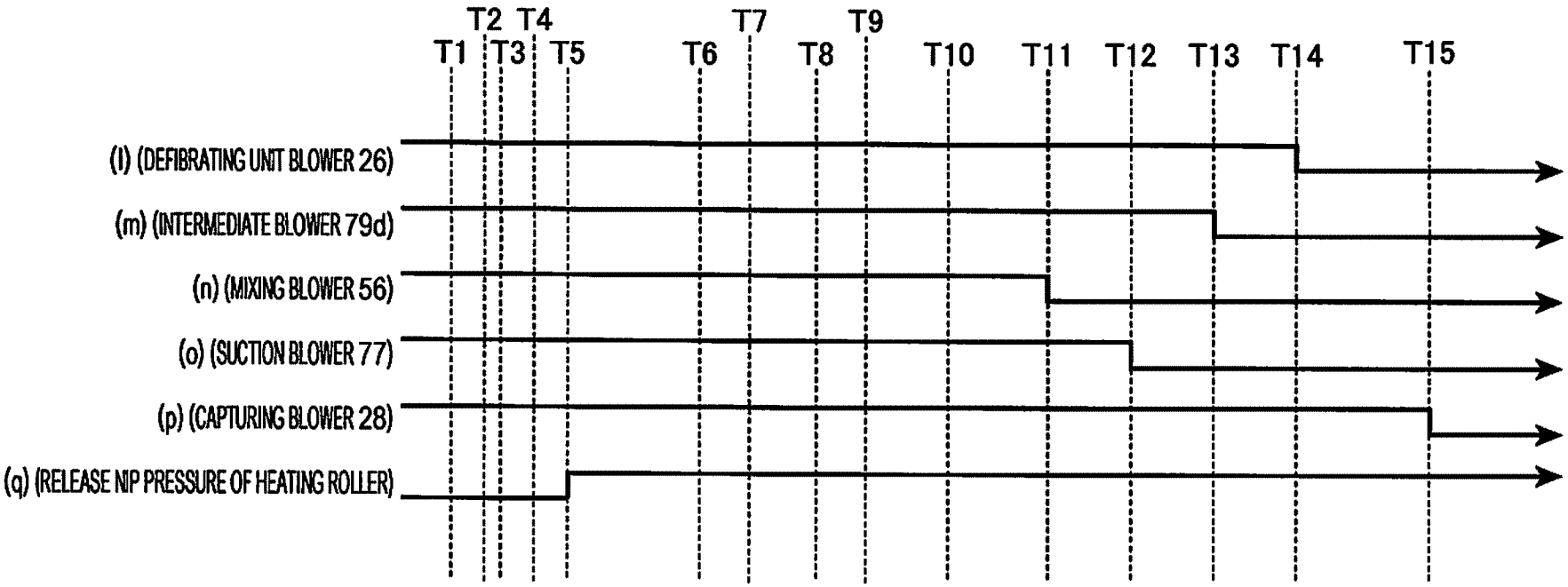
FIG. 6 is a timing chart illustrating the operation of the sheet manufacturing apparatus.

In addition, FIG. 5 and FIG. 6 are timing charts illustrating the operation of the sheet manufacturing apparatus 100 and illustrate a change in the operating state of each drive unit in a case where the sheet manufacturing apparatus 100 is stopped.

In FIG. 5, the operation of the paper feeding motor 315 is illustrated in (a). The operation of the grinding unit drive motor 311 is illustrated in (b). The operation of the defibrating unit drive motor 313 is illustrated in (c). The operation of the drum drive motor 325 is illustrated in (d). The operation of the belt drive motor 327 is illustrated in (e). The operation of the additive supply motor 319 is illustrated in (f). The operation of the drum drive motor 331 is illustrated in (g). The operation of the belt drive motor 333 is illustrated in (h). The operation of the pressing unit drive motor 337 is illustrated in (i). The operation of the heating unit drive motor 335 is illustrated in (j). The operation of the cutting unit drive motor 351 is illustrated in (k).

In FIG. 6, the operation of the defibrating unit blower 26 is illustrated in (l). The operation of the intermediate blower 79*d* is illustrated in (m). The operation of the mixing blower 56 is illustrated in (n). The operation of the suction blower 77 is illustrated in (o). The operation of the capturing blower 28 is illustrated in (p). An operation of releasing the nip pressure of the heating rollers 86 is illustrated in (q).

The operating states of each motor and each blower are illustrated in (a) to (k) in FIG. 5 and (l) to (p) in FIG. 6. A state where operation is ON is denoted by a High level, and a state where operation is OFF is denoted by a Low level. A state where the nip pressure of the heating rollers 86 is released is denoted by the High level, and a state where the nip pressure is imparted is denoted by the Low level in (q) in FIG. 6.

In a case where it is sensed that a stop trigger is switched ON (step S11 in FIG. 4), the control unit 150 waits until the drive timing of the cutting unit 90 (step S12; No). In a case where the cutting unit drive motor 351 is driven at the drive timing of the cutting unit 90 (step S12; Yes), the control unit 150 initiates a stop sequence (step S13).

For example, the stop trigger of the sheet manufacturing apparatus 100 is an operation of providing an apparatus stop instruction performed by the operator. For example, the stop trigger corresponds to a case where the operator provides the apparatus stop instruction by operating the touch sensor 117. In addition, in a case where an operation stop time is preset for the sheet manufacturing apparatus 100, the control unit 150 senses that the stop trigger is switched ON when the operation stop time is reached. In this case, the control device 110 may include a real time clock (RTC) that tracks the current time.

In a case where the stop sequence is initiated, first, each unit including the drum unit 41 of the selecting unit 40 and the drum unit 61 of the accumulating unit 60 is stopped by control of the control unit 150 (step S14).

In the timing chart in FIG. 5, a timing at which the stop trigger is switched ON is denoted by T1. As illustrated in (k) in FIG. 5, at time T2, the stop sequence is initiated at the operation timing of the cutting unit drive motor 351, and the drum drive motor 325 and the drum drive motor 331 are stopped. Accordingly, the drum unit 41 and the drum unit 61 are stopped. In addition, at time T2, as illustrated in (f) in FIG. 5, the additive supply motor 319 is stopped. In addition, the operation of the supply unit 10 is stopped. Accordingly, supply of the raw material to the grinding unit 12 is stopped, and supply of the additive by the additive supply unit 52 is also stopped.

Next, the mesh belt 72 of the second web forming unit 70 is stopped by control of the control unit 150 (step S15). As illustrated in (h) in FIG. 5, at time T4, the belt drive motor 333 is stopped. In addition, the heating unit drive motor 335 is stopped at time T3 as illustrated in (j) in FIG. 5, and the pressing unit drive motor 337 is stopped at time T5 as illustrated in (i) in FIG. 5. An operation in which the pressing unit 82 and the heating unit 84 transport the sheet S is stopped. That is, rotation of the calender rollers 85 is stopped at time T5 in accordance with a timing at which the mesh belt 72 is stopped by stopping the belt drive motor 333 at time T4. By matching the timing, trouble such that the second web W2 is stuck can be prevented. In addition, in a case where the sheet manufacturing apparatus 100 is started for the next time, manufacturing of the sheet S can be quickly initiated. Rotation of the calender rollers 85 may be stopped earlier by approximately 100 ms than the timing at which the mesh belt 72 stops.

By the above operation, the second half of the step of manufacturing the sheet S, that is, the operation of the accumulating unit 60, the second web forming unit 70, and the sheet forming unit 80 after the mixing blower 56, is almost stopped. In addition, as illustrated in (q) in FIG. 6, the nip pressure of the heating rollers 86 is released after time T5. Accordingly, adhesion of the sheet S to the heating rollers 86 by stopping transport of the sheet S can be prevented.

Next, the discharge unit 52*a* is closed by control of the control unit 150 (step S16). As illustrated in (f) in FIG. 5, the additive supply motor 319 is driven in order to close the discharge unit 52*a*, and the discharge unit 52*a* is closed after time elapses to time T9.

After closing of the discharge unit 52*a* is initiated, the first half of the step of manufacturing the sheet S, that is, each unit before the pipe 54, is stopped by the control of the control unit 150. Specifically, the grinding unit 12 is stopped (step S17). Deceleration of the mesh belt 46 is initiated in the first web forming unit 45 (step S18). Deceleration of the defibrating unit 20 is initiated (step S19).

The operations from step S16 to step S21 are not limited to a configuration in which the operations are executed in the order illustrated in FIG. 4, and, for example, may be executed at the same time.

As illustrated in (b) in FIG. 5, the grinding unit drive motor 311 stops at time T7, and the rotational speed of the belt drive motor 327 is decreased from time T7. As illustrated in (c) in FIG. 5, deceleration of the defibrating unit drive motor 313 is initiated slightly after time T7. Deceleration of the defibrating unit drive motor 313 continues until time T11 and stops at time T11. In a period A, the defibrating unit drive motor 313 continues decelerating until its speed becomes equal to zero.

Meanwhile, as illustrated in (e) in FIG. 5, the belt drive motor 327 decelerates until time T10 and stops at time T10. The belt drive motor 327 may decelerate stepwise or gradually in a period B (time T7 to T10) or may rotate at a constant speed lower than that of the normal operation. Thus, in the period B, the mesh belt 46 is driven in a decelerating manner or at a constant speed lower than the speed V1 of the normal operation.

At time T10, the belt drive motor 327 stops, and the mesh belt 46 stops (step S20). Furthermore, at time T11, the defibrating unit drive motor 313 stops, and the defibrating unit 20 stops (step S21).

The defibrating unit 20 rotates the rotor (not illustrated) at a high speed in order to finely defibrate the raw material. Thus, in a case where the defibrating unit 20 is stopped, the speed needs to be decreased stepwise or gradually, and the amount of time of the period A is required in the present embodiment. In the period A, the defibrated matter is supplied to the selecting unit 40 from the defibrating unit 20. Thus, by transporting the mesh belt 46 by operating the belt drive motor 327, thick accumulation of the first selected matter on a part of the mesh belt 46 can be prevented. In addition, since supply of the raw material to the grinding unit 12 stops at time T2, the grinding unit 12 stops at time T7, and the defibrating unit 20 decelerates, the amount of supply of the defibrated matter in the period A is smaller than that of the normal operation. Accordingly, in a case where the mesh belt 46 is operated at the same speed V1 as the normal operation until time T11, there is a possibility that the thickness of the accumulated matter accumulated on the mesh belt 46 becomes smaller than that of the normal operation. Therefore, by operating the belt drive motor 327 at a lower speed than the normal operation in the period B and stopping the belt drive motor 327 before time T11, the thickness of the first selected matter accumulated on the mesh belt 46 can be appropriately set. The belt drive motor 327 may be driven until time T11 at a further decreased speed.

In such a manner, the control unit 150 operates the mesh belt 46 for at least a preset time (for example, the period B) after a decrease in the operating speed of the defibrating unit 20 is initiated at time T7. Accordingly, the sheet manufacturing apparatus 100 can be stopped in a state where an appropriate amount of the defibrated matter is present in the first web forming unit 45 without excessively accumulating the defibrated matter in the defibrating unit 20 or the first web forming unit 45.

In addition, the control unit 150 stops the grinding unit drive motor 311 at time T7 at which a decrease in the operating speed of the defibrating unit 20 is initiated, and stops supply of the raw material to the defibrating unit 20 from the grinding unit 12. Thus, the amount of the raw material accumulated inside the defibrating unit 20 in a case where the defibrating unit 20 is stopped can be decreased. Accordingly, an increase in load at the time of rebooting or a discharge of a non-defibrated material at the time of rebooting can be prevented.

In addition, in the period B in which the mesh belt 46 is driven by the belt drive motor 327, the capturing blower 28 operates. Thus, the first selected matter can be quickly accumulated on the mesh belt 46.

In addition, the operation of the mist type humidifier 345 may be initiated at the same time as driving of the belt drive motor 327.

Then, each blower is stopped by control of the control unit 150. First, the mixing blower 56, the suction blower 77, the intermediate blower 79*d*, and the defibrating unit blower 26 stop in order (step S22). Then, the capturing blower 28 stops (step S23).

Specifically, as illustrated in (n) in FIG. 6, the mixing blower 56 stops at time T11. As illustrated in (o) in FIG. 6, the suction blower 77 stops at time T12. As illustrated in (m) in FIG. 6, the intermediate blower 79*d* stops at time T13. Next, as illustrated in (p) in FIG. 6, the capturing blower 28 stops at time T15. Since the capturing blower 28 stops at last, diffusion of the removed matter inside the sheet manufacturing apparatus 100 can be prevented.

By the above operation illustrated in FIG. 4 to FIG. 6, the sheet manufacturing apparatus 100 is stopped in a state where the material of the sheet S remains in the drum unit 41, the mesh belt 46, the pipe 54, the drum unit 61, the mesh belt 72, and the transport unit 79.

Figure 7:
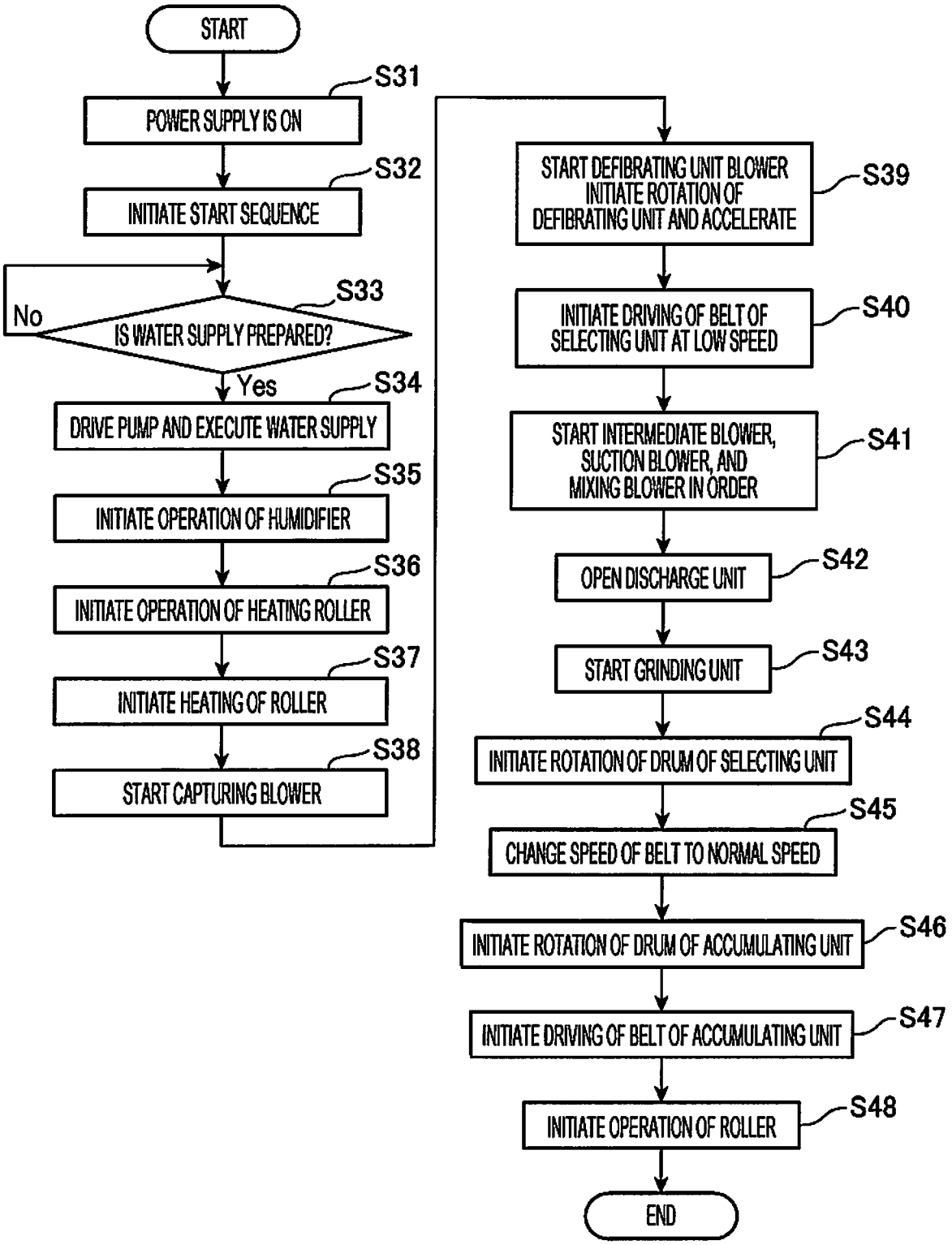
FIG. 7 is a flowchart illustrating the operation of the sheet manufacturing apparatus.
Figure 8:
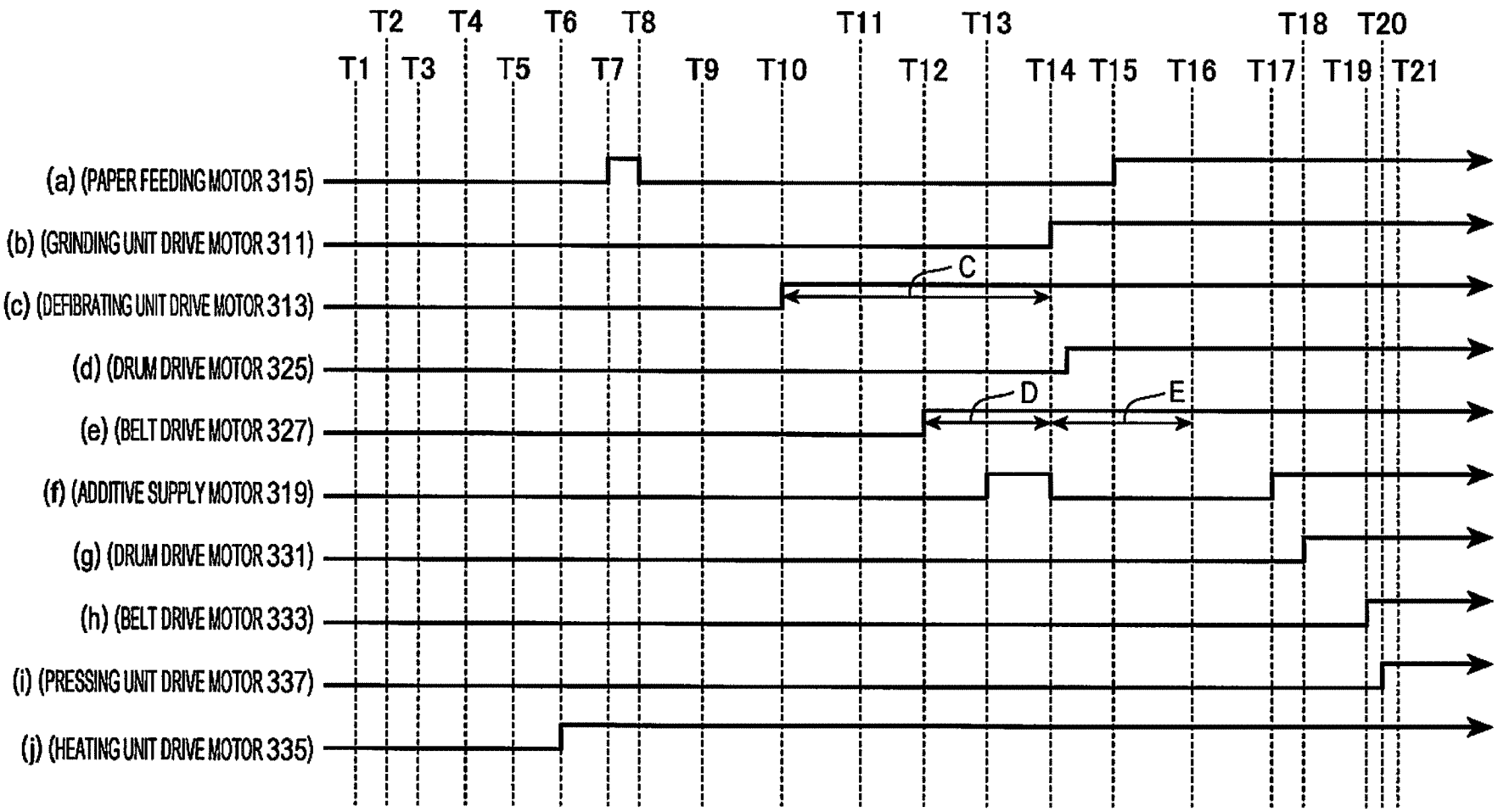
FIG. 8 is a timing chart illustrating the operation of the sheet manufacturing apparatus.
Figure 9:
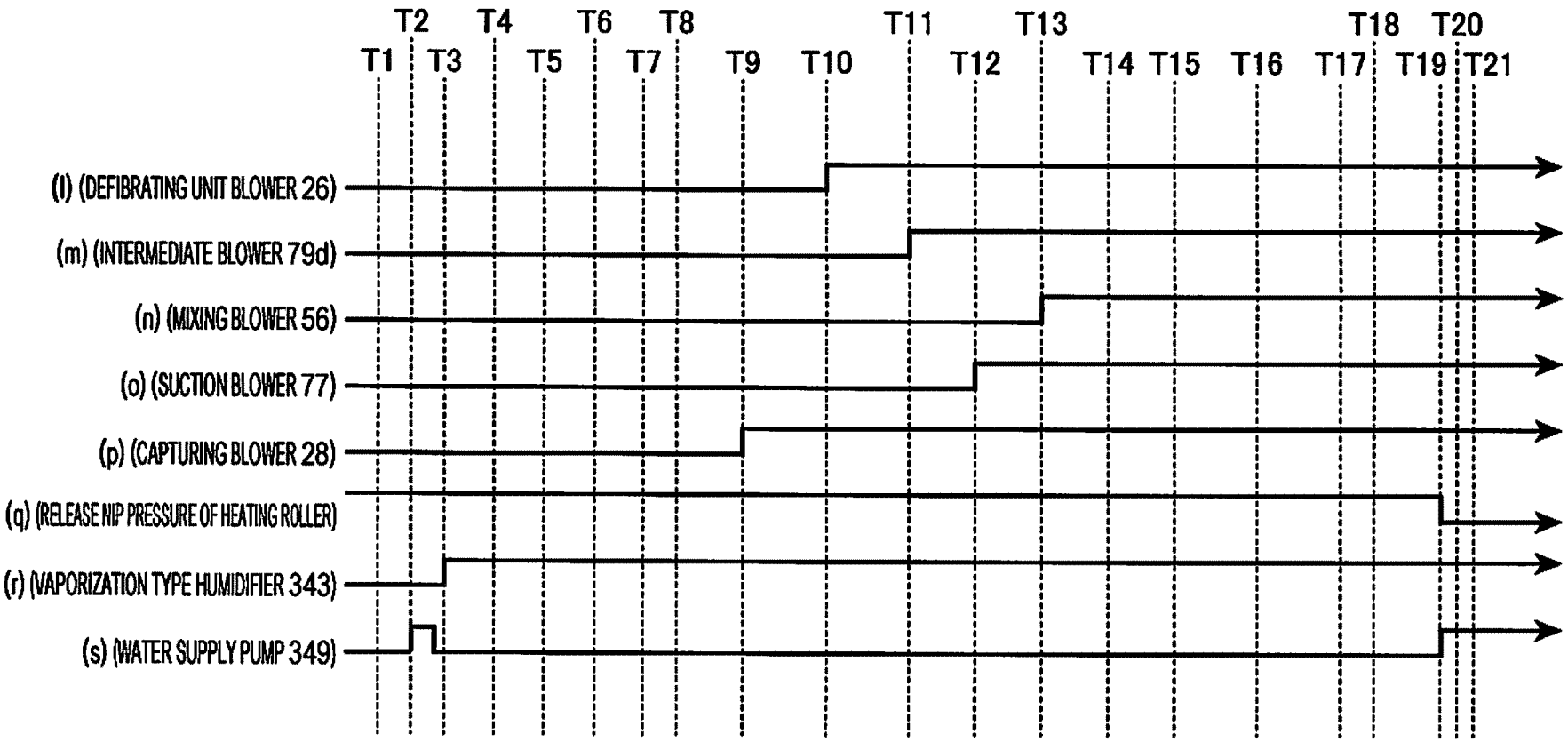
FIG. 9 is a timing chart illustrating the operation of the sheet manufacturing apparatus.

FIG. 7 is a flowchart illustrating the operation of the sheet manufacturing apparatus 100 and particularly, illustrates an operation of starting the sheet manufacturing apparatus 100 by control of the control unit 150. In addition, FIG. 8 and FIG. 9 are timing charts illustrating the operation of the sheet manufacturing apparatus 100 and illustrate a change in the operating state of each drive unit in a case where the sheet manufacturing apparatus 100 is started. The operation illustrated in FIG. 7 to FIG. 9 is an operation in a case where the sheet manufacturing apparatus 100 is started from a state where the sheet manufacturing apparatus 100 is stopped by the stop sequence illustrated in FIG. 4 to FIG. 6, and corresponds to a start control of the present invention. Accordingly, the start operation described below is an operation in a case where the sheet manufacturing apparatus 100 is started from a state where the material of the sheet S remains inside the sheet manufacturing apparatus 100.

In FIG. 8, the operation of the paper feeding motor 315 is illustrated in (a). The operation of the grinding unit drive motor 311 is illustrated in (b). The operation of the defibrating unit drive motor 313 is illustrated in (c). The operation of the drum drive motor 325 is illustrated in (d). The operation of the belt drive motor 327 is illustrated in (e). The operation of the additive supply motor 319 is illustrated in (f). The operation of the drum drive motor 331 is illustrated in (g). The operation of the belt drive motor 333 is illustrated in (h). The operation of the pressing unit drive motor 337 is illustrated in (i). The operation of the heating unit drive motor 335 is illustrated in (j).

In FIG. 9, the operation of the defibrating unit blower 26 is illustrated in (l). The operation of the intermediate blower 79*d* is illustrated in (m). The operation of the mixing blower 56 is illustrated in (n). The operation of the suction blower 77 is illustrated in (o). The operation of the capturing blower 28 is illustrated in (p). An operation of releasing the nip pressure of the heating rollers 86 is illustrated in (q). The operation of the vaporization type humidifier 343 is illustrated in (r). The operation of the water supply pump 349 is illustrated in (s).

In a case where a power supply ON instruction is provided to the sheet manufacturing apparatus 100 by an operation or the like performed on a power supply ON switch not illustrated (step S31), the control unit 150 initiates a start sequence (start control) (step S32).

The control unit 150 waits until supply of water to the sheet manufacturing apparatus 100 is prepared (step S33;

No). In a case where it is determined that water supply is prepared by an operation or the like performed by the operator (step S33; Yes), the control unit 150 supplies water by operating the water supply pump 349 (step S34).

In the timing charts in FIG. 8 and FIG. 9, the start sequence is initiated at time T1. As illustrated in (s) in FIG. 9, the water supply pump 349 is started at time T2. In a case where supply of a sufficient amount of water is detected by the water amount sensor 304, the control unit 150 stops the water supply pump 349.

Next, the control unit 150 initiates the operation of the vaporization type humidifier (step S35). As illustrated in (r) in FIG. 9, the operation of the vaporization type humidifier 343 is initiated at time T3, and supply of humidified air to the humidifying units 202, 204, 206, and 208 is initiated. Accordingly, a space in which a material moves inside the sheet manufacturing apparatus 100 can be humidified before a motor and the like are started.

The control unit 150 initiates the operation of the heating unit 84 (step S36) and initiates heating of the heating rollers 86 (step S37). Then, as illustrated in (j) in FIG. 8, the operation of the heating unit drive motor 335 is initiated at time T6, and rotation of the heating rollers 86 is initiated. In addition, while illustration is not provided, the roller heating unit 341 is switched ON at time T6, and heating is initiated.

In addition, at time T7, initialization of the supply unit 10 is executed along with operation initiation. In addition, the paper feeding motor 315 is driven as illustrated in (a) in FIG. 8.

Next, the control unit 150 starts the capturing blower 28 (step S38) and then, starts the defibrating unit blower 26 and initiates rotation of the defibrating unit drive motor 313 (step S39). As described above, since the defibrating unit 20 rotates at a high speed, the defibrating unit drive motor 313 accelerates immediately after its start.

As illustrated in (p) in FIG. 9, by starting the capturing blower 28 earlier than other blowers, scattering of the removed matter inside the sheet manufacturing apparatus 100 can be prevented. As illustrated in (l) in FIG. 9, the defibrating unit blower 26 is started at time T10. As illustrated in (c) in FIG. 8, the defibrating unit drive motor 313 is switched ON at time T10. The defibrating unit drive motor 313 is accelerated to the speed of the normal operation during a period C to time T14.

Furthermore, the control unit 150 starts the intermediate blower 79*d*, the suction blower 77, and the mixing blower 56 in order (step S40).

Specifically, as illustrated in (m) in FIG. 9, the intermediate blower 79*d* is started at time T11. As illustrated in (o) in FIG. 9, the suction blower 77 is started. As illustrated in (n) in FIG. 9, the mixing blower 56 is started at time T13. Since the mixing blower 56 sends air toward the accumulating unit 60, there is a possibility that the material is separated from the mesh belts 72 and 79*a* by the airflow in a case where the mixing blower 56 is started in a state where the suction blower 77 and the intermediate blower 79*d* are stopped. Thus, it is preferable that the mixing blower 56 be started after the suction blower 77 and the intermediate blower 79*d* initiate drawing. In addition, the control unit 150 drives the belt drive motor 327 and initiates driving of the mesh belt 46 (step S41). As will be described below, the control unit 150 performs a control for decreasing the speed of the belt drive motor 327 after operation initiation and increasing the speed stepwise.

The control unit 150 opens the discharge unit 52*a* (step S42), starts the grinding unit 12 (step S43), and initiates rotation of the drum unit 41 of the selecting unit 40 (step S44). Then, the control unit 150 changes the speed of the mesh belt 46 to the speed V1 of the normal operation (step S45).

Specifically, as illustrated in (f) in FIG. 8, the additive supply motor 319 operates from time T13. Accordingly, the discharge unit 52*a* is set to be in an open state from a closed state. This operation requires an amount of time to time T14. In addition, as illustrated in (b) in FIG. 8, at time T14, the grinding unit drive motor 311 is started, and the operation of the grinding unit 12 is initiated. In addition, as illustrated in (d) in FIG. 8, the drum drive motor 325 is started slightly later than time T14.

While the defibrating unit 20 has already been started at time T14, the raw material (ground matter) is not supplied to the defibrating unit 20 until the grinding unit 12 is started. Thus, the amount of the defibrated matter sent to the selecting unit 40 by the defibrating unit 20 before time T14 is small. In a case where supply of the ground matter is initiated by the grinding unit 12 at time T14, the defibrating unit 20 sends the defibrated matter to the selecting unit 40 slightly later. At this timing, the drum drive motor 325 is started, and the operation of the drum unit 41 is initiated. That is, after the start of the sheet manufacturing apparatus 100, the operation of the drum unit 41 is initiated in accordance with the timing at which the defibrating unit 20 initiates supply of the defibrated matter.

As illustrated in (e) in FIG. 8, the control unit 150 starts the belt drive motor 327 at time T12 at which the suction blower 77 is booted, or at a slightly earlier timing than time T12. The control unit 150 sets the operating speed of the belt drive motor 327 to a low speed during a predetermined period after the start of the belt drive motor 327. In the present embodiment, the speed of the mesh belt 46 is set to a lower speed than the speed V1 of the normal operation, for example, a speed of ⅛ of the speed V1, during a period D to time T14. Then, for example, at time T14, the control unit 150 increases the operating speed of the belt drive motor 327. The speed after increase is a lower speed than the speed V1 of the normal operation. In the present embodiment, the speed of the mesh belt 46 is set to ⅓ of the speed V1 of the normal operation during a period E from time T14 to T16. After the elapse of the period E, at time T16, the control unit 150 switches the speed of the belt drive motor 327 to the speed of the normal operation, and the speed of the mesh belt 46 becomes equal to the speed V1 of the normal operation.

In the period D, the drum unit 41 is in a non-operating state. Thus, the mesh belt 46 operates at a very low speed. In the period E, the drum unit 41 operates, and the first selected matter falls to the mesh belt 46 from the drum unit 41. Thus, it is preferable that the mesh belt 46 be operated. However, since the period E is immediately after initiation of the operation of the grinding unit 12 and the drum unit 41, there is a possibility that the amount of falling first selected matter is not stable. Accordingly, in a case where the mesh belt 46 is operated at the speed V1 of the normal operation, there is a possibility that the thickness of the first web W1 accumulated on the mesh belt 46 is decreased. In the period E, it is effective that the mesh belt 46 is moved at a low speed even in a case where an increase in the thickness of the first web W1 is considered. The operating speed of the belt drive motor 327 is switched to the speed of the normal operation at time T16. In addition, in the period E, the speed of the belt drive motor 327 may be increased stepwise or gradually. Even in the period D, the speed of the belt drive motor 327 may not be constant and may be increased stepwise or gradually.

In addition, as illustrated in (a) in FIG. 8, at time T15, the operation of the paper feeding motor 315 is initiated, and supply of the raw material to the grinding unit 12 is initiated.

The control unit 150 initiates rotation of the drum unit 61 of the accumulating unit 60 (step S46) and initiates driving of the mesh belt 72 (step S47). At the time when rotation of the drum unit 61 is initiated, introduction of the mixture into the drum unit 61 is started since the mixing blower 56 has already been started.

As illustrated in (g) in FIG. 8, the operation of the drum drive motor 331 is initiated at time T18. Then, as illustrated in (h) in FIG. 8, the operation of the belt drive motor 333 is initiated at time T19. The reason why the timing of the start of the belt drive motor 333 is later than the drum drive motor 331 is that a cut in the second web W2 is avoided by sufficiently securing the thickness of the second web W2 accumulated on the mesh belt 72.

That is, the control unit 150 increases the thickness of the second web W2 formed after start by setting the timing of initiating movement of the mesh belt 72 to time T19 that is later than time T18 at which rotation of the drum unit 61 is initiated. In such a manner, the control unit 150 controls at least one of the timing at which rotation of the drum unit 61 is initiated, the rotational speed of the drum unit 61, the timing at which movement of the mesh belt 72 is initiated, and the movement speed of the mesh belt 72. By this control, the control unit 150 can adjust the thickness of the second web W2 formed by the second web forming unit 70.

In the case of partially increasing the thickness of the second web W2, the control unit 150 can perform a control that is different from the method of setting the timing of starting the belt drive motor 333 to be later than the drum drive motor 331 as described above. For example, the control unit 150 may rotate the drum unit 61 at a higher speed than the normal operation by controlling the rotational speed of the drum drive motor 331. This high speed rotation may be performed at, for example, time T18 to T19. In this case, since the amount of the mixture falling to the mesh belt 72 from the drum unit 61 is increased, the thickness of the second web W2 can be increased. In this case, the belt drive motor 333 may be started at the same time as the drum drive motor 331. In addition, the control unit 150 may set the movement speed of the mesh belt 72 to a lower speed than the speed V2 of the normal operation by controlling the rotational speed of the belt drive motor 333. Even in this case, the thickness of the mixture accumulated on the mesh belt 72 is increased. Thus, the thickness of the second web W2 can be increased.

In the case of decreasing the thickness of the second web W2, the control unit 150 may set the movement speed of the mesh belt 72 to a higher speed than the speed V2 of the normal operation by controlling the rotational speed of the belt drive motor 333. In addition, the control unit 150 may rotate the drum unit 61 at a lower speed than the normal operation by controlling the rotational speed of the drum drive motor 331. In such a manner, the control unit 150 can adjust the thickness of the second web W2 by temporarily changing the rotational speeds of the drum drive motor 331 and the belt drive motor 333.

In the example illustrated in (q) in FIG. 9, at the time of start, the nip pressure of the heating rollers 86 is released by the nip pressure adjusting unit 353. At time T19, the nip pressure of the heating rollers 86 is applied in accordance with the timing at which movement of the second web W2 is initiated by the start of the belt drive motor 333. The control unit 150 may not release the nip pressure at the time of start and may increase the nip pressure to a nip pressure (a nip pressure such that the leading edge of the second web W2 can easily pass through the nip unit) lower than the set nip pressure.

The control unit 150 initiates rotation of the calender rollers 85 of the pressing unit 82 (step S48). As illustrated in (i) in FIG. 8, the pressing unit drive motor 337 is started at time T20 after the operation of the belt drive motor 333 is initiated at time T19. Accordingly, the second web W2 is processed by the sheet forming unit 80 without a cut, and the sheet S is manufactured.

While the order in which the control unit 150 stops and starts each drive unit of the sheet manufacturing apparatus 100 is illustrated as a flow in FIG. 4 and FIG. 7, it is not intended to limit execution of the flow control by the control unit 150 based on a single program. FIG. 4 to FIG. 6 and FIG. 7 to FIG. 9 illustrate the order or the manner in which the operating state of each drive unit changes as a result of control of the control unit 150, and a method of implementing such a control is not limited. For example, the control unit 150 may parallelly control a plurality of drive units or may control each drive unit in accordance with an independent control program. In addition, the control unit 150 may implement the operation in FIG. 4 to FIG. 6 and FIG. 7 to FIG. 9 by hardware control.

The operation illustrated in FIG. 4 to FIG. 6 is executed in a state where the sheet manufacturing apparatus 100 is performing the normal operation, that is, when an operation of manufacturing the sheet S based on the raw material supplied to the grinding unit 12 and discharging the manufactured sheet S from the cutting unit 90 is being performed.

As described above, the sheet manufacturing apparatus 100 to which the present invention is applied includes the defibrating unit 20 that defibrates the raw material including the fibers in the atmosphere. In addition, the accumulating unit 60 that includes the drum unit 61 in which a plurality of openings are formed, and discharges the defibrated matter defibrated by the defibrating unit 20 by causing the defibrated matter to pass through the openings by rotating the drum unit 61 is included. In addition, the second web forming unit 70 that includes the mesh belt 72 on which the defibrated matter which has passed through the openings of the accumulating unit 60 is accumulated, and forms the second web W2 by operating the mesh belt 72 is included. In addition, the sheet forming unit 80 that forms the sheet S from the second web W2 formed by the second web forming unit 70 is included. In addition, the cutting unit 90 that cuts the sheet S formed by the sheet forming unit 80 into a preset size is included. The sheet manufacturing apparatus 100 includes the control unit 150 that executes the stop control with the cut operation of the cutting unit 90 as a trigger in a case where an instruction to stop the apparatus is provided. In the stop control, the control unit 150 stops the operation of the defibrating unit 20 after stopping rotation of the drum unit 61 and movement of the mesh belt 72.

In addition, the control unit 150 applies the control method for the sheet manufacturing apparatus 100 of the present invention. In the stop control for stopping the sheet manufacturing apparatus 100, the control unit 150 stops the operation of the defibrating unit 20 after stopping rotation of the drum unit 61 and movement of the mesh belt 72.

According to the sheet manufacturing apparatus 100 and the control method for the sheet manufacturing apparatus 100, a series of controls for stopping the sheet manufacturing apparatus 100 is executed with an operation of cutting the sheet S by the cutting unit 90 as a trigger. In the stop control, an operation of defibrating the raw material by the defibrating unit 20 is executed even after the mesh belt 72 and the drum unit 61 are stopped. Then, the defibrating unit 20 is stopped. Thus, the sheet manufacturing apparatus 100 stops in a state where the defibrated matter is supplied from the defibrating unit 20. Accordingly, in a case where the sheet manufacturing apparatus 100 is stopped, since the leading edge part of the sheet S can be stopped at an appropriate position, winding of the sheet onto the transport roller or sticking of the sheet at the time of a stoppage or the time of rebooting can be reduced. In addition, the sheet manufacturing apparatus 100 can be stopped in a state where the defibrated matter remains inside the sheet manufacturing apparatus 100. At the time of next booting, supply of the defibrated matter to the second web forming unit 70 is quickly initiated, and manufacturing of the sheet S can be initiated. Accordingly, the timing of stopping the cutting unit 90, the drum unit 61, the mesh belt 72, and the defibrating unit 20 in a case where the sheet manufacturing apparatus 100 is stopped can be appropriately set.

In addition, in the stop control, for a predetermined time, the control unit 150 executes a control for decreasing the operating speed of the defibrating unit 20 from the speed of the normal operation before the stop control and then, stops the defibrating unit 20. Accordingly, the defibrating unit 20 can be smoothly stopped. For example, in a configuration in which the defibrating unit 20 includes a rotor that rotates at a high speed, a malfunction or exhaustion caused by suddenly stopping the defibrating unit 20 can be prevented, and the sheet manufacturing apparatus 100 that stably operates can be implemented.

In addition, the sheet manufacturing apparatus 100 includes the selecting unit 40 that selects the defibrated matter defibrated by the defibrating unit 20 as the first selected matter and the second selected matter. In addition, the first web forming unit 45 that includes the mesh belt 46 on which the first selected matter selected by the selecting unit 40 is accumulated, and separates the first selected matter by operating the mesh belt 46 is included. The control unit 150 operates the mesh belt 46 for at least a preset time after a decrease in the operating speed of the defibrating unit 20 is initiated. Accordingly, the defibrated matter that is defibrated during deceleration of the defibrating unit 20 can be separated by the first web forming unit 45. Accordingly, the sheet manufacturing apparatus 100 can be stopped in a state where an appropriate amount of the defibrated matter is present in the first web forming unit 45 without excessively accumulating the defibrated matter in the first web forming unit 45.

In addition, the sheet manufacturing apparatus 100 includes the grinding unit 12 that grinds the raw material and supplies the raw material to the defibrating unit 20. The control unit 150 stops supply of the raw material to the defibrating unit 20 from the grinding unit 12 at the timing at which deceleration of the defibrating unit 20 is initiated. Accordingly, the amount of the raw material accumulated inside the defibrating unit 20 in a case where the defibrating unit 20 is stopped can be decreased. Accordingly, an increase in load at the time of rebooting can be prevented. In addition, by stopping supply of the raw material in a state where the performance of the defibration process is decreased by decelerating the defibrating unit 20, a decrease in the quality of the defibrated matter can be prevented.

In addition, the control unit 150 sets the movement speed of the mesh belt 46 to a lower speed than the speed of the normal operation before the stop control while the operating speed of the defibrating unit 20 is decreased. Accordingly, even in a case where the amount of supply of the defibrated matter is reduced by a decrease in the performance of the defibration process caused by deceleration of the defibrating unit 20, a sufficient amount of the first selected matter can be accumulated on the mesh belt 46. Thus, the occurrence of variation in the amount of accumulation on the mesh belt 46 can be avoided, and the quality of the sheet S manufactured in the case of the next start can be stabilized.

In addition, the sheet manufacturing apparatus 100 includes the capturing blower 28 that draws the mesh belt 46 in order to accumulate the first selected matter. The control unit 150 operates the capturing blower 28 while the mesh belt 46 is moved. Accordingly, the first selected matter can be quickly accumulated on the mesh belt 46. Accordingly, a fault caused by floating first selected matter not being accumulated on the mesh belt 46, insufficiency of fibers on the mesh belt 46, and the like can be prevented, and the quality of the sheet S can be stabilized.

In addition, the sheet manufacturing apparatus 100 includes the additive supply unit 52 that includes the openable and closable discharge unit 52*a* and supplies resin from the discharge unit 52*a*. In addition, the sheet manufacturing apparatus 100 includes the mixing unit 50 that mixes the resin supplied by the additive supply unit 52 with the first selected matter separated by the first web forming unit 45 in the atmosphere. The mixture mixed by the mixing unit 50 is introduced into the drum unit 61. In the stop control, the control unit 150 performs a control for stopping supply of the resin from the additive supply unit 52 in accordance with the timing at which rotation of the drum unit 61 and movement of the mesh belt 72 are stopped, and then, closing the discharge unit 52*a*. Accordingly, by stopping supply of the resin in accordance with the timing of stopping the drum unit 61 and the mesh belt 72 and closing the discharge unit 52*a*, unnecessary movement of resin during a stoppage of the sheet manufacturing apparatus 100 is prevented. Accordingly, imbalance of the amount of resin inside the apparatus, insufficiency of resin, or excessive accumulation of the mixture can be prevented, and the quality of the sheet S manufactured in a case where the sheet manufacturing apparatus 100 is started for the next time can be stabilized.

In addition, the sheet forming unit 80 includes the calender rollers 85 that pinch and press the sheet S formed by the second web forming unit 70. The control unit 150 stops rotation of the calender rollers 85 in accordance with the timing at which movement of the mesh belt 72 included in the second web forming unit 70 is stopped in the stop control. Accordingly, since rotation of the calender rollers 85 is stopped in accordance with the timing at which the mesh belt 72 stops movement of the second web W2, trouble such as sticking of the second web W2 can be prevented. In addition, in a case where the sheet manufacturing apparatus 100 is started for the next time, manufacturing of the sheet S can be quickly initiated.

The embodiment is merely a specific manner of embodying the present invention disclosed in the claims and does not limit the present invention. Not all configurations described in the embodiment are necessarily essential constituents of the present invention. In addition, the invention is not limited to the configuration of the embodiment and can be embodied in various manners without departing from its nature.

The sheet manufacturing apparatus 100 may be configured to manufacture not only the sheet S but also a hard sheet, a board shape configured with stacked sheets, or manufactured matter having a web shape. In addition, the sheet S may be paper made of pulp or old paper as the raw material or may be non-woven fabric including natural fibers or fibers made of synthetic resin. In addition, the properties of the sheet S are not particularly limited. The sheet S may be paper that can be used as recording paper (for example, so-called PPC paper) for the purpose of writing or printing or may be wallpaper, wrapping paper, color paper, drawing paper, Kent paper, or the like. In addition, in a case where the sheet S is non-woven fabric, the sheet S may be not only general non-woven fabric but also a fiber board, tissue paper, kitchen paper, a cleaner, a filter, a liquid absorbing material, a sound absorbing body, a shock absorbing material, a mat, or the like.

In addition, while the embodiment illustrates a configuration in which the sheet S is cut by the cutting unit 90, a configuration in which the sheet S processed by the sheet forming unit 80 is wound and picked up by a winding pick-up roller may be used.

In addition, at least a part of each function block illustrated in FIG. 2, FIG. 3, and the like may be implemented by hardware or may be configured to be implemented by cooperation between hardware and software and is not limited to a configuration in which independent hardware resources are arranged as illustrated in the drawings. In addition, the program executed by the control unit may be stored in the non-volatile storage unit or other storage devices (not illustrated). In addition, a configuration in which the program stored in an external device is executed by acquiring the program through a communication unit may be used.

REFERENCE SIGNS LIST

2, 3, 7, 8, 23, 29 PIPE
9 CHUTE
10 SUPPLY UNIT
12 GRINDING UNIT
14 GRINDING BLADE
20 DEFIBRATING UNIT
22 INTRODUCTION PORT
24 DISCHARGE PORT
26 DEFIBRATING UNIT BLOWER
27 DUST COLLECTING UNIT
28 CAPTURING BLOWER (SEPARATION DRAWING UNIT)
40 SELECTING UNIT
41 DRUM UNIT
42 INTRODUCTION PORT
43 HOUSING UNIT
45 FIRST WEB FORMING UNIT (SEPARATING UNIT)
46 MESH BELT (SEPARATING BELT)
47 STRETCHING ROLLER
48 DRAWING UNIT
49 ROTATING BODY
50 MIXING UNIT
52 ADDITIVE SUPPLY UNIT (RESIN SUPPLY UNIT)
52*a* DISCHARGE UNIT
54 PIPE
56 MIXING BLOWER (TRANSFER BLOWER)
60 ACCUMULATING UNIT
61 DRUM UNIT (DRUM)
62 INTRODUCTION PORT
63 HOUSING UNIT
70 SECOND WEB FORMING UNIT (WEB FORMING UNIT)
72 MESH BELT (BELT)
74 STRETCHING ROLLER
76 SUCTION MECHANISM
77 SUCTION BLOWER (ACCUMULATION DRAWING UNIT)
79 TRANSPORT UNIT
79*a* MESH BELT
79*b* STRETCHING ROLLER
79*c* SUCTION MECHANISM
79*d* INTERMEDIATE BLOWER
80 SHEET FORMING UNIT
82 PRESSING UNIT
84 HEATING UNIT
85 CALENDER ROLLER (ROLLER)
86 HEATING ROLLER
90 CUTTING UNIT (CUTTER UNIT)
92 FIRST CUTTING UNIT
94 SECOND CUTTING UNIT
96 DISCHARGE UNIT
100 SHEET MANUFACTURING APPARATUS
110 CONTROL DEVICE
140 STORAGE UNIT
150 CONTROL UNIT
202, 204, 206, 208, 210, 212 HUMIDIFYING UNIT
301 OLD PAPER REMAINING AMOUNT SENSOR
302 ADDITIVE REMAINING AMOUNT SENSOR
303 PAPER DISCHARGE SENSOR
304 WATER AMOUNT SENSOR
305 TEMPERATURE SENSOR
306 AIR AMOUNT SENSOR
307 AIR SPEED SENSOR
311 GRINDING UNIT DRIVE MOTOR
313 DEFIBRATING UNIT DRIVE MOTOR
315 PAPER FEEDING MOTOR
319 ADDITIVE SUPPLY MOTOR
325 DRUM DRIVE MOTOR
327 BELT DRIVE MOTOR
329 DIVIDING UNIT DRIVE MOTOR
331 DRUM DRIVE MOTOR
333 BELT DRIVE MOTOR
335 HEATING UNIT DRIVE MOTOR
337 PRESSING UNIT DRIVE MOTOR
341 ROLLER HEATING UNIT
343 VAPORIZATION TYPE HUMIDIFIER
345 MIST TYPE HUMIDIFIER
349 WATER SUPPLY PUMP
351 CUTTING UNIT DRIVE MOTOR
372 TO 392 DRIVE IC

The invention claimed is:

1. A sheet manufacturing apparatus comprising:

a defibrating unit that defibrates a raw material including fibers in an atmosphere;

an accumulating unit that includes a drum in which a plurality of openings are formed, and discharges defibrated matter defibrated by the defibrating unit by causing the defibrated matter to pass through the openings by rotating the drum;

a web forming unit that includes a belt on which the defibrated matter passing through the openings is accumulated, and forms a web by operating the belt;

a sheet forming unit that forms a sheet from the web formed by the web forming unit;

a cutter unit that cuts the sheet formed by the sheet forming unit into a preset size;

a cutting unit drive motor that drives the cutter unit; and a control unit that executes a stop control of the sheet manufacturing apparatus in a case where an instruction to stop the apparatus is provided, to execute the stop control, the control unit sensing that a stop trigger as an apparatus stop instruction is on, waiting until a drive timing at which the cutting unit performs a cut operation upon sensing that the stop trigger is on, driving the cutter unit drive motor at the drive timing such that the cutting unit performs the cut operation, and commencing the stop control at a timing of the cutting unit drive motor changing from on to off;

wherein in the stop control, the control unit stops operation of the defibrating unit after stopping rotation of the drum and movement of the belt.

2. The sheet manufacturing apparatus according to claim 1, wherein in the stop control, for a predetermined time, the control unit executes a control for decreasing an operating speed of the defibrating unit from a speed in a normal operation before the stop control and then, stops the defibrating unit.

3. The sheet manufacturing apparatus according to claim 2, further comprising:

a selecting unit that selects the defibrated matter defibrated by the defibrating unit as first selected matter and second selected matter; and a separating unit that includes a separating belt on which the first selected matter selected by the selecting unit is accumulated, and separates the first selected matter by operating the separating belt, wherein the control unit operates the separating belt for at least a preset time from initiation of a decrease in the operating speed of the defibrating unit.

4. The sheet manufacturing apparatus according to claim 3, further comprising:

a grinding unit that grinds the raw material and supplies the raw material to the defibrating unit, wherein the control unit stops supply of the raw material to the defibrating unit from the grinding unit at a timing of initiating deceleration of the defibrating unit.

5. The sheet manufacturing apparatus according to claim 3, wherein the control unit sets a movement speed of the separating belt to a speed lower than the speed in the normal operation before the stop control while the operating speed of the defibrating unit is decreased.

6. The sheet manufacturing apparatus according to claim 3, wherein the separating belt is configured with a mesh belt, the sheet manufacturing apparatus further comprises a separation drawing unit that draws the separating belt in order to accumulate the first selected matter, and the control unit operates the separation drawing unit while the separating belt moves.

7. The sheet manufacturing apparatus according to claim 3, further comprising:

a resin supply unit that includes an openable and closable discharge unit and supplies resin from the discharge unit; and a mixing unit that mixes the resin supplied by the resin supply unit with the first selected matter separated by the separating unit in the atmosphere, wherein a mixture that is mixed by the mixing unit is introduced into the drum, and in the stop control, the control unit performs a control for stopping supply of the resin from the resin supply unit in accordance with a timing of stopping the rotation of the drum and the movement of the belt and then, closing the discharge unit.

8. The sheet manufacturing apparatus according to claim 1, wherein the sheet forming unit includes a roller that pinches and presses the sheet formed by the web forming unit, and in the stop control, the control unit stops rotation of the roller in accordance with a timing of stopping the movement of the belt included in the web forming unit.

9. A control method for a sheet manufacturing apparatus in a stop control for stopping the sheet manufacturing apparatus, the sheet manufacturing apparatus including a defibrating unit that defibrates a raw material including fibers in an atmosphere, an accumulating unit that includes a drum in which a plurality of openings are formed, and discharges defibrated matter defibrated by the defibrating unit by causing the defibrated matter to pass through the openings by rotating the drum, a web forming unit that includes a belt on which the defibrated matter passing through the openings is accumulated, and forms a web by operating the belt, a sheet forming unit that forms a sheet from the web formed by the web forming unit, a cutter unit that cuts the sheet formed by the sheet forming unit into a preset size, and a cutting unit drive motor that drives the cutter unit, and the method comprising:

sensing that a stop trigger as an apparatus stop instruction is on;

waiting until a drive timing at which the cutting unit performs a cut operation upon sensing that the stop trigger is on, and driving the cutter unit drive motor at the drive timing such that the cutting unit performs the cut operation;

commencing the stop control of the sheet manufacturing apparatus at a timing of the cutting unit drive motor changing from on to off; and stopping operation of the defibrating unit after stopping rotation of the drum and movement of the belt.

* * * * *